US009776393B2

(12) United States Patent
Ueshima

(10) Patent No.: US 9,776,393 B2
(45) Date of Patent: Oct. 3, 2017

(54) METHOD FOR ANALYZING POSITIONAL DISPLACEMENT BETWEEN HEAD MODULES, METHOD FOR ADJUSTING RECORDING HEAD, AND IMAGE RECORDING APPARATUS

(71) Applicant: FUJIFILM Corporation, Tokyo (JP)

(72) Inventor: Masashi Ueshima, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/373,475

(22) Filed: Dec. 9, 2016

(65) Prior Publication Data

US 2017/0165959 A1 Jun. 15, 2017

(30) Foreign Application Priority Data

Dec. 9, 2015 (JP) ..... 2015-240480

(51) Int. Cl.

| | |
|---|---|
| ***B41J 29/38*** | (2006.01) |
| ***B41J 29/393*** | (2006.01) |
| ***B41J 2/045*** | (2006.01) |
| ***B41J 2/155*** | (2006.01) |

(52) U.S. Cl.

CPC ..... *B41J 2/04505* (2013.01); *B41J 2/04586* (2013.01); *B41J 2/155* (2013.01); *B41J 29/393* (2013.01)

(58) Field of Classification Search

CPC ..... B41J 29/393; B41J 2/04505; B41J 2/04586; B41J 2/155; B41J 29/38

USPC ..... 347/5, 9, 14, 19, 20, 40

See application file for complete search history.

(56) References Cited

U.S. PATENT DOCUMENTS 8,496,312 B2 * 7/2013 Sakurada ..... B41J 2/04503 347/14
8,870,338 B2 * 10/2014 Kyoso ..... B41J 2/14 347/19
8,960,849 B2 2/2015 Kyoso

FOREIGN PATENT DOCUMENTS

JP 2014083720 5/2014

* cited by examiner

*Primary Examiner* — An Do
(74) *Attorney, Agent, or Firm* — Jianq Chyun IP Office

(57) ABSTRACT

The positional displacement shift amount between the head modules is calculated in a first dynamic range and with a first arithmetic accuracy, and calculated in a second dynamic range wider than the first dynamic range and with a second arithmetic accuracy rougher than the first arithmetic accuracy and finer than the first dynamic range, and as a positional displacement shift amount between the head modules in the first direction, the positional displacement shift amount with the second arithmetic accuracy is selected if the positional displacement shift amount with the second arithmetic accuracy exceeds the first dynamic range, and the positional displacement shift amount with the first arithmetic accuracy is selected if within the first dynamic range.

11 Claims, 25 Drawing Sheets

FIG.20A

| LINE# | A16 | A15 | A14 | A13 | A12 | A11 | A10 | A9 | A8 | A7 | A6 | A5 | A4 | A3 | A2 | A1 |
|---|---|---|---|---|---|---|---|---|---|---|---|---|---|---|---|---|
| NOZZLE# | 1 | 13 | 25 | 37 | 49 | 61 | 73 | 85 | 97 | 109 | 121 | 133 | 145 | 157 | 169 | 181 |
| COORDINATE | -15p | -14p | -13p | -12p | -11p | -10p | -9p | -8p | -7p | -6p | -5p | -4p | -3p | -2p | -1p | 0 |

| LINE# | B1 | B2 | B3 | B4 | B5 | B6 | B7 | B8 | B9 | B10 | B11 | B12 | B13 | B14 | B15 |
|---|---|---|---|---|---|---|---|---|---|---|---|---|---|---|---|
| NOZZLE# | 193 | 205 | 217 | 229 | 241 | 253 | 265 | 277 | 289 | 301 | 313 | 325 | 337 | 349 | 361 |
| COORDINATE | p+Δx | 2p+Δx | 3p+Δx | 4p+Δx | 5p+Δx | 6p+Δx | 7p+Δx | 8p+Δx | 9p+Δx | 10p+Δx | 11p+Δx | 12p+Δx | 13p+Δx | 14p+Δx | 15p+Δx |

FIG.20B

| LINE# | A17 | A16 | A15 | A14 | A13 | A12 | A11 | A10 | A9 | A8 | A7 | A6 | A5 | A4 | A3 | A2 |
|---|---|---|---|---|---|---|---|---|---|---|---|---|---|---|---|---|
| NOZZLE# | 1 | 13 | 25 | 37 | 49 | 61 | 73 | 85 | 97 | 109 | 121 | 133 | 145 | 157 | 169 | 181 |
| COORDINATE | -15p | -14p | -13p | -12p | -11p | -10p | -9p | -8p | -7p | -6p | -5p | -4p | -3p | -2p | -1p | 0 |

| LINE# | A1 | B1 | B2 | B3 | B4 | B5 | B6 | B7 | B8 | B9 | B10 | B11 | B12 | B13 | B14 |
|---|---|---|---|---|---|---|---|---|---|---|---|---|---|---|---|
| NOZZLE# | 193 | 205 | 217 | 229 | 241 | 253 | 265 | 277 | 289 | 301 | 313 | 325 | 337 | 349 | 361 |
| COORDINATE | pΔ | 2p+Δx | 3p+Δx | 4p+Δx | 5p+Δx | 6p+Δx | 7p+Δx | 8p+Δx | 9p+Δx | 10p+Δx | 11p+Δx | 12p+Δx | 13p+Δx | 14p+Δx | 15p+Δx |

FIG.21

| LINE# | A4 | A3 | A2 | A1 | B1 | B2 | B3 | B4 |
|---|---|---|---|---|---|---|---|---|
| CONVERSION FACTOR | -4. 60 | -3. 26 | -2. 48 | -2. 00 | 2. 00 | 2. 48 | 3. 26 | 4. 60 |

FIG.22

| CONVERSION FACTOR AVERAGE | TOTAL NUMBER OF NOZZLES | STANDARD ERROR |
|---|---|---|
| 2. 00 | 24 | 1. 22 |
| 2. 24 | 48 | 0. 97 |
| 2. 58 | 72 | 0. 91 |
| 3. 09 | 96 | 0. 95 |

PATTERN (1)

PATTERN (2)

PATTERN (3)

FIG.24A

| LINE# | A13 | A12 | A11 | A10 | A9 | A8 | A7 | A6 | A5 | B1 | A4 | A3 | B2 | B3 | A2 | A1 |
|---|---|---|---|---|---|---|---|---|---|---|---|---|---|---|---|---|
| NOZZLE# | 1 | 12 | 23 | 34 | 45 | 56 | 67 | 78 | 89 | 100 | 111 | 122 | 133 | 144 | 155 | 166 |
| COORDINATE | -15p | -14p | -13p | -12p | -11p | -10p | -9p | -8p | -7p | -6p+Δx | -5p | -4p | -3p+Δx | -2p+Δx | -1p | 0 |

FIG.24B

| LINE# | B4 | B5 | B6 | B7 | B8 | B9 | B10 | B11 | B12 | B13 | B14 | B15 | B16 | B17 | B18 |
|---|---|---|---|---|---|---|---|---|---|---|---|---|---|---|---|
| NOZZLE# | 177 | 188 | 199 | 210 | 221 | 232 | 243 | 254 | 265 | 276 | 287 | 298 | 309 | 320 | 331 |
| COORDINATE | p+Δx | 2p+Δx | 3p+Δx | 4p+Δx | 5p+Δx | 6p+Δx | 7p+Δx | 8p+Δx | 9p+Δx | 10p+Δx | 11p+Δx | 12p+Δx | 13p+Δx | 14p+Δx | 15p+Δx |

FIG.25
| NUMBER OF DIVISIONS | 8 | 9 | 10 | 11 | 12 |
|---|---|---|---|---|---|
| STANDARD ERROR | 1. 12μm (N=48) | 0. 70μm (N=58) | 0. 71μm (N=66) | 0. 70μm (N=60) | 0. 91μm (N=72) |
FIG.26A
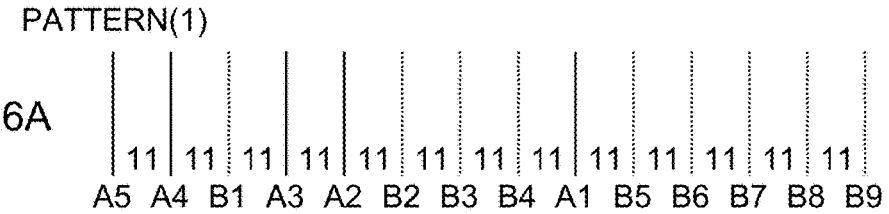
FIG.26B
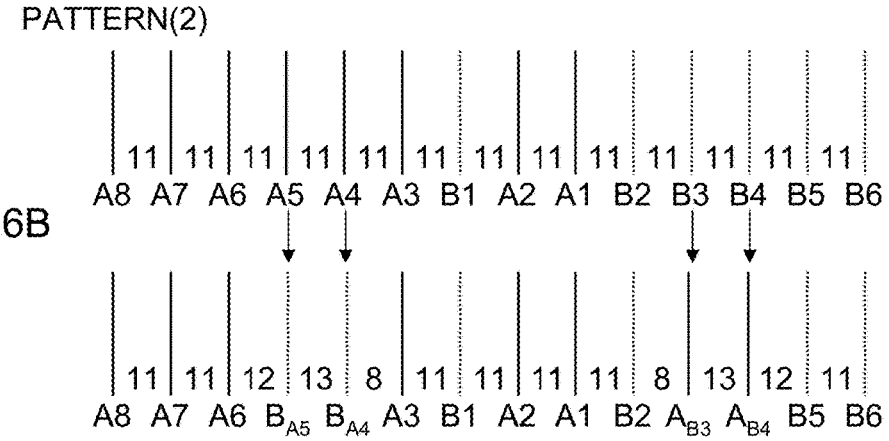
FIG.26C
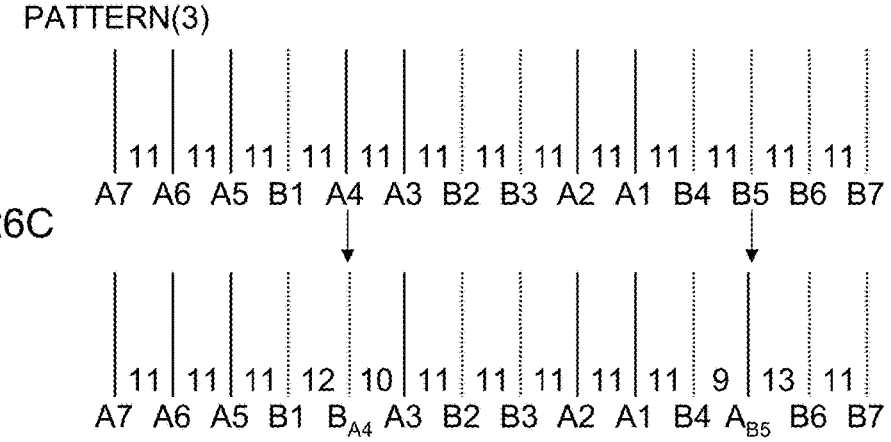

FIG.27A

| LINE# | A13 | A12 | A11 | A10 | A9 | A8 | A7 | A6 | A5 | B1 | $B_{A4}$ | A3 | B2 | B3 | A2 | A1 |
|---|---|---|---|---|---|---|---|---|---|---|---|---|---|---|---|---|
| NOZZLE# | 1 | 12 | 23 | 34 | 45 | 56 | 67 | 78 | 89 | 100 | 112 | 122 | 133 | 144 | 155 | 166 |
| COORDINATE | -15p | -14p | -13p | -12p | -11p | -10p | -9p | -8p | -7p | -6p+Δx | -5p+Δx+21. 2 | -4p | -3p+Δx | -2p+Δx | -1p | 0 |

FIG.27B

| LINE# | B4 | $A_{B5}$ | B6 | B7 | B8 | B9 | B10 | B11 | B12 | B13 | B14 | B15 | B16 | B17 | B18 |
|---|---|---|---|---|---|---|---|---|---|---|---|---|---|---|---|
| NOZZLE# | 177 | 186 | 199 | 210 | 221 | 232 | 243 | 254 | 265 | 276 | 287 | 298 | 309 | 320 | 331 |
| COORDINATE | p+Δx | 2p+Δx-42.3 | 3p+Δx | 4p+Δx | 5p+Δx | 6p+Δx | 7p+Δx | 8p+Δx | 9p+Δx | 10p+Δx | 11p+Δx | 12p+Δx | 13p+Δx | 14p+Δx | 15p+Δx |

FIG.28

| | CONVERSION FACTOR AVERAGE | TOTAL NUMBER OF NOZZLES | STANDARD ERROR |
|---|---|---|---|
| 0 | 1.31 | 31 | 0.7062 |
| 1 | 1.56 | 58 | 0.6134 |
| 2 | 1.72 | 74 | 0.6001 |
| 3 | 1.75 | 76 | 0.6008 |
| 4 | 1.65 | 56 | 0.6620 |

METHOD FOR ANALYZING POSITIONAL DISPLACEMENT BETWEEN HEAD MODULES, METHOD FOR ADJUSTING RECORDING HEAD, AND IMAGE RECORDING APPARATUS

CROSS-REFERENCE TO RELATED APPLICATIONS

The present application claims priority under 35 U.S.C. §119 to Japanese Patent Application No. 2015-240480, filed on Dec. 9, 2015. The above application is hereby expressly incorporated by reference, in its entirety, into the present application.

BACKGROUND OF THE INVENTION

Field of the Invention

The present invention relates to a method for analyzing a positional displacement between head modules, a method for adjusting a recording head, and an image recording apparatus.

Description of the Related Art

In a field of inkjet drawing, in order to attain a high drawing resolution and high productivity, a head module having many nozzles two-dimensionally arrayed thereon is formed, a plurality of head modules are aligned in a recording medium width direction to form a long head (full-line type head) which covers an area to be drawn of an entire width of the recording medium. There has been known an inkjet drawing technique for forming an image on a recording surface of the recording medium by relatively scanning the recording medium one time in a direction vertical to a width direction of this long head (single-pass printing).

The long head having a plurality of head modules aligned thereon in this way has had a problem that unless head modules joining is carried out with high accuracy, nozzle intervals in the width direction are differentiated at a portion joining the head modules to deteriorate the quality of a formed image.

To deal with such a problem, Japanese Patent Application Laid-Open No. 2014-083720 discloses that in a method for analyzing a positional displacement between head modules of an inkjet head in which a plurality of head modules are connected and joined, by dividing a printing pattern by means of the head module to create division patterns, determining a conversion factor for each nozzle of the division pattern, and changing the number of nozzles used for calculation, a minimum value of a standard error of a between-modules depositing positional displacement shift amount between the head modules is determined, the number of divisions of the division patterns is changed, calculation of the conversion factor and calculation of the standard error are repeatedly carried out with the division pattern after the changing to determine the number of divisions and the number of nozzles where a value of the standard error is minimum.

According to this technology, since the number of divisions and number of nozzles of the printing pattern where the standard error is smaller are determined in advance to determine the between-modules depositing positional displacement shift amount between the head modules, an accuracy of the between-modules depositing positional displacement shift amount can be improved.

SUMMARY OF THE INVENTION

However, in the technology described in Japanese Patent Application Laid-Open No. 2014-083720, when the between-modules depositing positional displacement shift amount between the head modules exceeds a certain amount, it is not possible to accurately calculate a depositing positional error required for calculating the between-modules depositing positional displacement shift amount, giving rise to a problem that measurement of the between-modules depositing positional displacement shift amount cannot be correctly carried out. On the other hand, there has been a problem that no guarantee is given that the between-modules depositing positional displacement shift amount falls within a range of value capable of correctly calculating the depositing positional error in an initial attaching condition of the head module.

The present invention has been made in consideration of such a circumstance, and has an object to provide a method for analyzing a positional displacement between head modules, a method for adjusting a recording head, and an image recording apparatus, which are capable of measuring the positional displacement shift amount even in a state where the positional displacement shift amount between the head modules is large and capable of obtaining a measurement result with high accuracy in a state where the positional displacement shift amount is small.

In order to achieve the above object, an aspect of a method for analyzing a positional displacement between head modules is a method for analyzing a positional displacement between head modules of a recording head in which plural head modules each having a plurality of recording elements arranged thereon are connected and joined in a first direction, and the head modules adjacent to each other have an overlapping area in a second direction crossing the first direction, the method including a first measurement chart recording step of recording a first measurement chart on a recording medium by the recording head, a first measurement chart reading-out step of reading out the recorded first measurement chart by a reading-out device to acquire read data of the first measurement chart, a precise analyzing step of analyzing the read data of the first measurement chart in a first dynamic range to calculate a positional displacement shift amount between the head modules in the first direction with a first arithmetic accuracy, a second measurement chart recording step of recording a second measurement chart on a recording medium by the recording head, a second measurement chart reading-out step of reading out the recorded second measurement chart by the reading-out device to acquire read data of the second measurement chart, a rough analyzing step of analyzing the read data of the second measurement chart in a second dynamic range wider than the first dynamic range to calculate the positional displacement shift amount between the head modules in the first direction with a second arithmetic accuracy rougher than the first arithmetic accuracy and finer than the first dynamic range, and a measurement result selecting step of selecting the positional displacement shift amount with the second arithmetic accuracy as the positional displacement shift amount between the head modules in the first direction in a case where the positional displacement shift amount with the second arithmetic accuracy calculated in the rough analyzing step exceeds the first dynamic range, and selecting the positional displacement shift amount with the first arithmetic accuracy calculated in the precise analyzing step as the positional displacement shift amount between the head modules in the first direction in a case where the positional displacement shift amount with the second arithmetic accuracy is within the first dynamic range.

According to this aspect, the positional displacement shift amount between the head modules in the first direction is calculated in the first dynamic range with the first arithmetic accuracy, and further calculated in the second dynamic range wider than the first dynamic range with the second arithmetic accuracy rougher than the first arithmetic accuracy and finer than the first dynamic range, and the positional displacement shift amount with the second arithmetic accuracy is selected as the positional displacement shift amount between the head modules in the first direction if the positional displacement shift amount with the second arithmetic accuracy exceeds the first dynamic range, and the positional displacement shift amount with the first arithmetic accuracy is selected as the positional displacement shift amount between the head modules in the first direction if the positional displacement shift amount with the second arithmetic accuracy is within the first dynamic range, and thus, even in a state where the positional displacement shift amount between the head modules is large, the positional displacement shift amount can be measured, and in a state where the positional displacement shift amount is small, a measurement result with high accuracy can be obtained.

It is preferable that in the second measurement chart recording step, the respective head modules adjacent to each other independently record the second measurement chart, and in the rough analyzing step, respective physical positions of the head modules adjacent to each other are independently calculated. This makes it possible to calculate the positional displacement shift amount between the head modules in the first direction in the second dynamic range wider than the first dynamic range.

It is preferable that in the second measurement chart recording step, the second measurement chart including a plurality of line images is recorded by a plurality of recording elements respectively predefined from the head modules adjacent to each other, and in the rough analyzing step, read data of the plurality of line images is analyzed to independently calculate the respective physical positions of the head modules adjacent to each other. This makes it possible to appropriately calculate the positional displacement shift amount in the first direction with the second arithmetic accuracy.

It is preferable that in the rough analyzing step, a least-square technique is applied to the read data of the plurality of line images to generate a mapping function between a position of a read pixel of the reading-out device in the first direction and a position of the recording element in the first direction. This makes it possible to appropriately calculate the positional displacement shift amount in the first direction with the second arithmetic accuracy.

It is preferable that in the rough analyzing step, a readout resolving capability of the reading-out device is calculated on the basis of the mapping function. This makes it possible to correct optical performance of the reading-out device.

It is preferable that the line image is a line image extending along the second direction, and a length of the line image in the first direction is longer than the readout resolving capability in the second measurement chart reading-out step. This allows the second arithmetic accuracy to be improved.

It is preferable that in the first measurement chart recording step, the head modules adjacent to each other are used in combination to mixedly record the first measurement chart, and in the precise analyzing step, the physical positions of the head modules adjacent to each other are dependently calculated. This makes it possible to appropriately calculate the positional displacement shift amount in the first direction with the first arithmetic accuracy.

It is preferable that the first measurement chart recording step and the second measurement chart recording step are performed on one recording medium. This allows the process in the precise analyzing step and the process in the rough analyzing step to be performed in parallel.

The embodiment also includes a non-transitory computer-readable recording medium including a program for analyzing a positional displacement between head modules using the method for analyzing a positional displacement between head modules.

In order to achieve the above object, an aspect of a method for adjusting a recording head, in a method for analyzing a positional displacement between head modules of a recording head in which plural head modules each having a plurality of recording elements arranged thereon are connected and joined in a first direction, and the head modules adjacent to each other have an overlapping area in a second direction crossing the first direction, includes a first measurement chart recording step of recording a first measurement chart on a recording medium by the recording head, a first measurement chart reading-out step of reading out the recorded first measurement chart by a reading-out device to acquire read data of the first measurement chart, a precise analyzing step of analyzing the read data of the first measurement chart in a first dynamic range to calculate a positional displacement shift amount between the head modules in the first direction with a first arithmetic accuracy, a second measurement chart recording step of recording a second measurement chart on a recording medium by the recording head, a second measurement chart reading-out step of reading out the recorded second measurement chart by the reading-out device to acquire read data of the second measurement chart, a rough analyzing step of analyzing the read data of the second measurement chart in a second dynamic range wider than the first dynamic range to calculate the positional displacement shift amount between the head modules in the first direction with a second arithmetic accuracy rougher than the first arithmetic accuracy and finer than the first dynamic range, and a measurement result selecting step of selecting the positional displacement shift amount with the second arithmetic accuracy as the positional displacement shift amount between the head modules in the first direction in a case where the positional displacement shift amount with the second arithmetic accuracy calculated in the rough analyzing step exceeds the first dynamic range, selecting the positional displacement shift amount with the first arithmetic accuracy calculated in the precise analyzing step as the positional displacement shift amount between the head modules in the first direction in a case where the positional displacement shift amount with the second arithmetic accuracy is within the first dynamic range, and an adjusting step of adjusting positional displacements of the head modules adjacent to each other according to the positional displacement shift amount between the head modules in the first direction selected in the measurement result selecting step.

According to this aspect, since the positional displacement is adjusted on the basis of the positional displacement shift amount between the head modules in the first direction selected as the positional displacement shift amount between the head modules in the first direction, even in a state where the positional displacement shift amount between the head modules is large, the positional displacement can be adjusted, and in a state where the positional displacement shift amount is small, the positional displacement with high accuracy can be adjusted.

In order to achieve the above object, an aspect of an image recording apparatus includes a recording head in which plural head modules each having a plurality of recording elements arranged thereon are connected and joined in a first direction, and the head modules adjacent to each other have an overlapping area in a second direction crossing the first direction, a moving device configured to move the recording head and a recording medium relative to each other, a first measurement chart recording device configured to record a first measurement chart on the recording medium by the recording head, a first measurement chart reading-out device configured to read out the recorded first measurement chart to acquire read data of the first measurement chart, a precise analyzing device configured to analyze the read data of the first measurement chart in a first dynamic range to calculate a positional displacement shift amount between the head modules in the first direction with a first arithmetic accuracy, a second measurement chart recording device configured to record a second measurement chart on the recording medium by the recording head, a second measurement chart reading-out device configured to read out the recorded second measurement chart to acquire read data of the second measurement chart, a rough analyzing device configured to analyze the read data of the second measurement chart in a second dynamic range wider than the first dynamic range to calculate the positional displacement shift amount between the head modules in the first direction with a second arithmetic accuracy rougher than the first arithmetic accuracy and finer than the first dynamic range, and a measurement result selecting device configured to select the positional displacement shift amount with the second arithmetic accuracy as the positional displacement shift amount between the head modules in the first direction in a case where the positional displacement shift amount with the second arithmetic accuracy calculated by the rough analyzing device exceeds the first dynamic range, and select the positional displacement shift amount with the first arithmetic accuracy calculated by the precise analyzing device as the positional displacement shift amount between the head modules in the first direction in a case where the positional displacement shift amount with the second arithmetic accuracy is within the first dynamic range.

According to this aspect, the positional displacement shift amount between the head modules in the first direction is calculated in the first dynamic range with the first arithmetic accuracy, and further calculated in the second dynamic range wider than the first dynamic range with the second arithmetic accuracy rougher than the first arithmetic accuracy and finer than the first dynamic range, and the positional displacement shift amount with the second arithmetic accuracy is selected as the positional displacement shift amount between the head modules in the first direction if the positional displacement shift amount with the second arithmetic accuracy exceeds the first dynamic range, and the positional displacement shift amount with the first arithmetic accuracy is selected as the positional displacement shift amount between the head modules in the first direction if the positional displacement shift amount with the second arithmetic accuracy is within the first dynamic range, and thus, even in a state where the positional displacement shift amount between the head modules is large, the positional displacement shift amount can be measured, and in a state where the positional displacement shift amount is small, a measurement result with high accuracy can be obtained.

According to the present invention, even in a state where the positional displacement shift amount between the head modules is large, the positional displacement shift amount can be measured, and in a state where the positional displacement shift amount is small, a measurement result with high accuracy can be obtained.

BRIEF DESCRIPTION OF THE DRAWINGS

FIGS. 20A and 20B each are a diagram illustrating a relationship between a nozzle number and a coordinate used for creating an approximate curve of a line;

FIG. 21 is a diagram illustrating a result of determined conversion factors;

FIG. 22 is a diagram illustrating a result of the total number of nozzles and the standard error;

FIGS. 24A and 24B are diagrams illustrating nozzle numbers and coordinates used for creating an approximate curve of a line;

FIG. 25 is a diagram illustrating a result representing the minimum value of the standard error in each division pattern;

FIGS. 26A to 26C each are a diagram illustrating an example of an unequal division pattern;

FIGS. 27A and 27B are table diagrams illustrating a relationship between a nozzle number and a coordinate used for creating an approximate curve of a line; and FIG. 28 is a diagram illustrating a relationship between the total number of nozzles and a standard error of Δx.

DETAILED DESCRIPTION OF THE EMBODIMENTS

Hereinafter, a description is given of preferred embodiments of the present invention with reference to the attached drawings.

<Outline of Inkjet Recording Apparatus>

Figure 1:
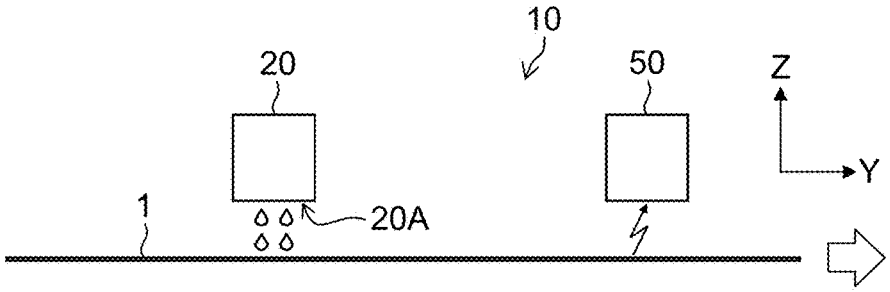
FIG. 1 is a lateral view illustrating an inkjet recording apparatus.
Figure 2:
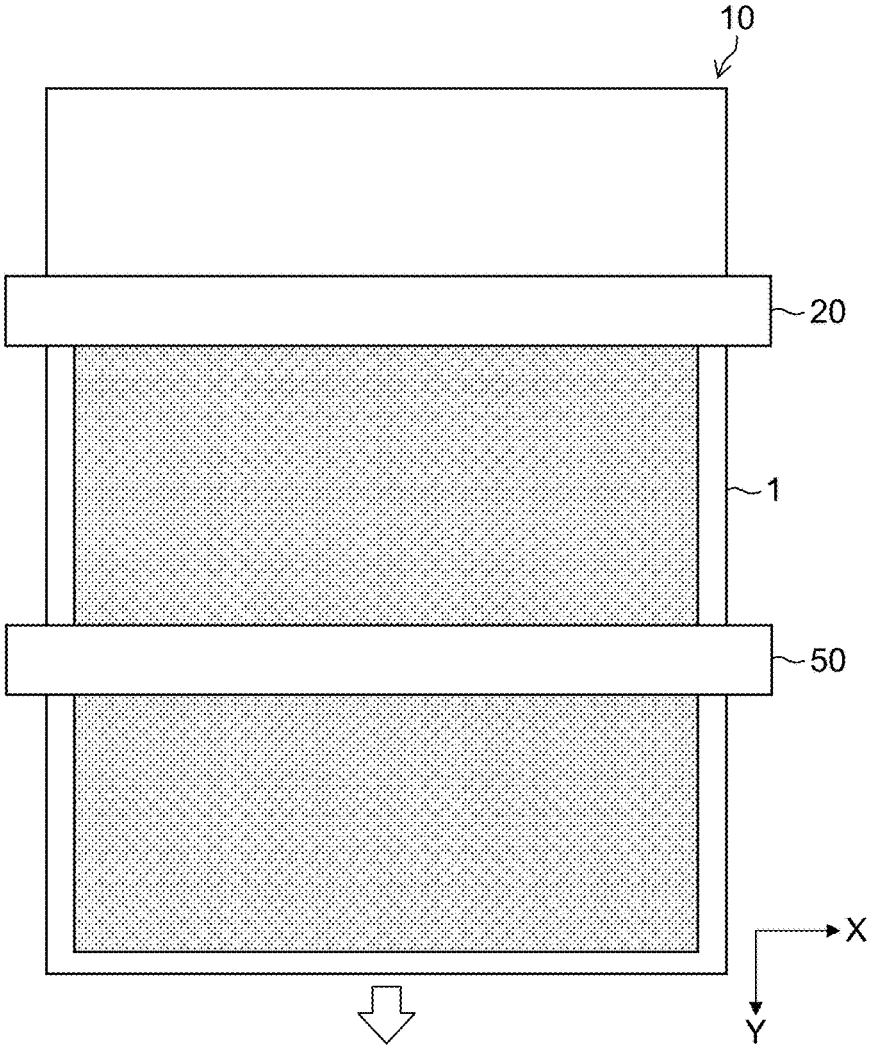
FIG. 2 is a plan view illustrating the inkjet recording apparatus.

FIG. 1 is a lateral view illustrating an inkjet recording apparatus according to the embodiment and FIG. 2 is a plan view thereof. An inkjet recording apparatus 10 (an example of the image recording apparatus) is a printer (an example of an image recording apparatus) which forms an image by ejecting an ink from a nozzle surface 20A of an inkjet head 20 (hereinafter, simply referred to as the head 20) as a recording head onto a recording surface of a paper sheet 1 (an example of a recording medium) which is conveyed by way of a medium conveyance unit 54 (see FIG. 12) in a Y direction (an example of a second direction). In the embodiment, the recording head includes at least an element for forming dots on the recording medium (recording element). A scanner 50 (an example of a reading-out device), which is provided on a downstream side of the head 20 in the Y direction, is configured to be capable of reading out an image formed on the recording surface of the paper sheet 1.

Figure 3:
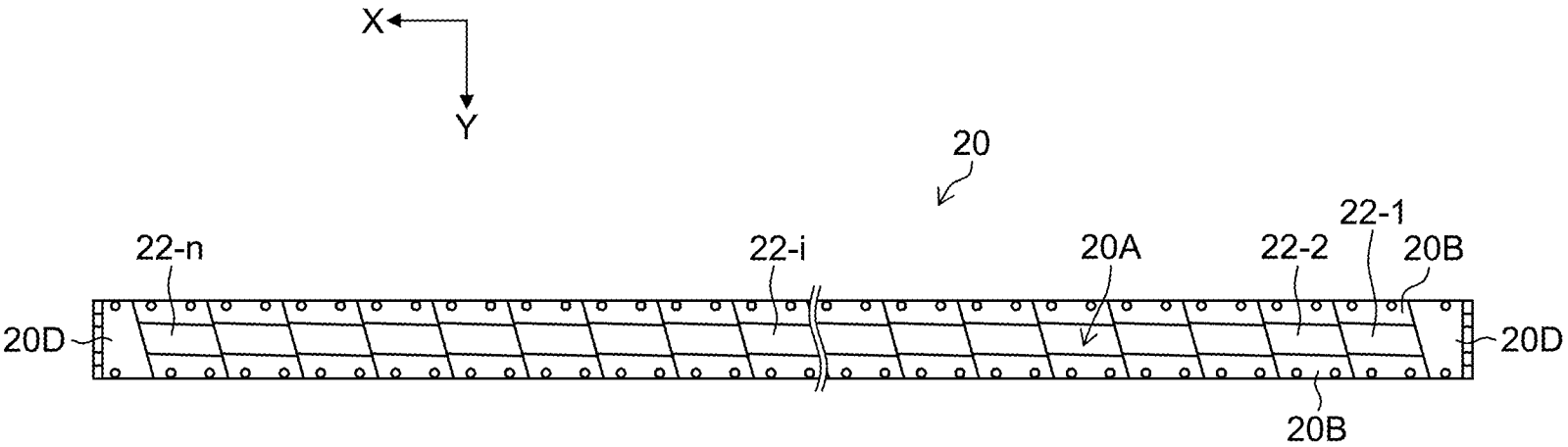
FIG. 3 is a plan view illustrating a structural example of an inkjet head.
Figure 4:
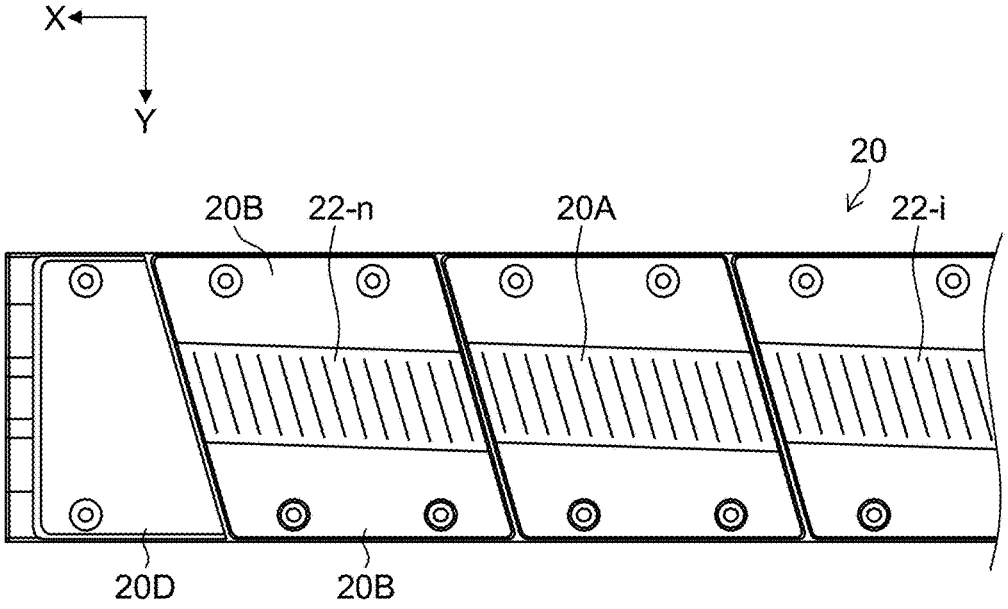
FIG. 4 is a partially enlarged view of FIG. 3.

FIG. 3 is a plan view illustrating a structural example of the head 20 and a diagram where the head 20 is seen from the nozzle surface 20A side. FIG. 4 is a partially enlarged view of FIG. 3.

As illustrated in FIG. 3, the head 20 has a configuration in which n head modules 22 (head modules 22-1, 22-2, 22-3, . . . , **22-*i*, . . . , 22-*n*) are joined along an X direction (an example of a first direction) vertical to (an example of crossing) the Y direction, and is provided with nozzles 24 that are a plurality of recording elements (see FIG. 4) across a length corresponding to an entire width of the paper sheet 1**. In the embodiment, the recording element refers to those arranged at a position corresponding to a recorded point on the recording medium and forming dots on the recording medium, and here, is a nozzle for inkjet printing. Other examples of the recording element may include a heating element for thermal transfer recording and an LED (Light Emitting Diode) element for electrophotographic recording.

The plural head modules 22 are connected and supported in the X direction by head module supporting members 20B from both sides in a lateral direction of the head 20. Both ends in a longitudinal direction of the head 20 are supported by head supporting members 20D.

As illustrated in FIG. 4, each head module 22 has a configuration in which plural nozzles are arrayed in a matrix (two-dimensionally).

Figure 5:
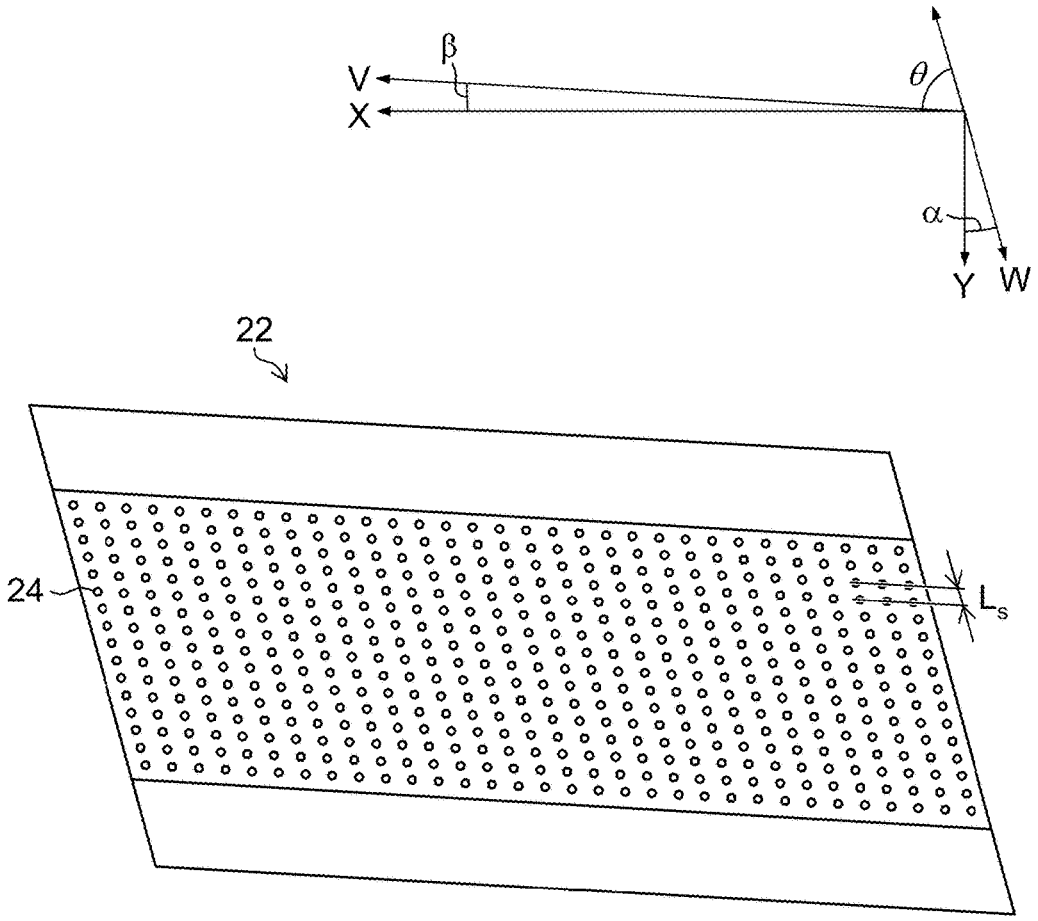
FIG. 5 is a plan view illustrating a nozzle array of a head module.

FIG. 5 is a plan view illustrating a nozzle array of the head module 22. As illustrated in the figure, the head module 22 has a configuration in which many nozzles 24 are aligned in a matrix along a column direction W at an angle α with respect to the Y direction and a row direction V at an angle β with respect to the X direction, and a substantial nozzle arranging density in the X direction is made highly dense.

The nozzle array applicable to the invention is not limited to the nozzle array illustrated in FIG. 5, and also applicable to, for example, an aspect in which the plural nozzles are arrayed in a matrix along the row direction along the X direction, or along the column direction oblique to the X direction and Y direction.

Figure 6:
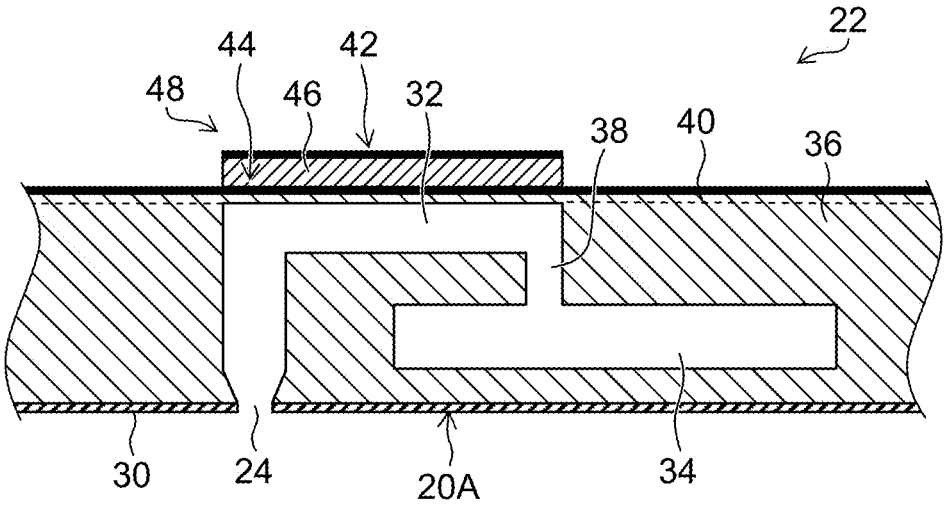
FIG. 6 is a cross-sectional view illustrating a three dimensional (stereo) structure of a droplet ejection element.

FIG. 6 is a cross-sectional view illustrating a stereo structure of a droplet ejection element of one channel as a unit of the recording element for the head module 22 (an ink chamber unit corresponding to one nozzle 24). As illustrated in the figure, the head 20 of this example (head module **22-*i*) has a structure in which layered and bonded are a nozzle plate 30 having the nozzle 24 formed thereon, a flow channel plate 36 in which a pressure chamber 32 and a flow channel such as a common flow channel 34 are formed, and the like. The nozzle plate 30 constitutes the nozzle surface 20A of the head 20, and has the plural nozzles 24 two-dimensionally formed thereon which respectively communicates with the pressure chambers 32**.

The flow channel plate 36 is a flow channel forming member which constitutes side wall portions of the pressure chamber 32 and forms a supply port 38 as a restricting section (most constricted portion) of an individual supply path for guiding the ink from the common flow channel 34 to the pressure chamber 32. For the sake of the description, a simplified view is given in FIG. 6, but the flow channel plate 36 has a structure formed by layering together one or a plurality of substrates.

The nozzle plate 30 and the flow channel plate 36 can be processed into a required shape by a semiconductor manufacturing process using silicon as a material.

The common flow channel 34 communicates with an ink tank (not illustrated) which is an ink supply source, and the ink supplied from the ink tank is supplied through the common flow channel 34 to the pressure chambers 32.

A diaphragm 40 constituting a part of the surface of the pressure chamber 32 (top surface in FIG. 6) is bonded with a piezoelectric actuator 48 which includes an individual electrode 42 and a lower electrode 44 and has a configuration in which a piezoelectric body 46 is sandwiched between the individual electrode 42 and the lower electrode 44. If the diaphragm 40 is formed of a metal thin film or a metal oxide film, it functions as a common electrode corresponding to the lower electrode 44 in the piezoelectric actuator 48. In an aspect in which the diaphragm is formed of a non-conductive material such as resin, a lower electrode layer made of a conductive material such as metal is formed on a surface of the diaphragm member.

When a drive voltage is applied to the individual electrode 42, the piezoelectric actuator 48 deforms to change a volume of the pressure chamber 32, which involves a pressured change to cause the ink to be ejected from the nozzle 24. After ejecting the ink, when the piezoelectric actuator 48 returns to its original state, the pressure chamber 32 is refilled with a new ink from the common flow channel 34 through the supply port 38.

Each head module 22 has many droplet ejection elements configured like this arranged thereon in a matrix in a constant array pattern along the row direction V at the angle β to the X direction and the column direction W at the angle α to the Y direction as illustrated in FIG. 5. Assuming that an interval between the nozzles adjacent to each other in the Y direction is Ls, the nozzles 24 can be regarded in the same way as they are substantially arrayed linearly at a constant pitch of $P_N$=Ls/tan θ in the X direction.

In this example, the piezoelectric actuator 48 is applied as an ejection force generating device for the ink ejected from the nozzles 24 which are provided to the head 20, but thermal ejecting may be applied in which a heater is provided in the pressure chamber 32 and a pressure due to film boiling caused by heating by the heater is used to eject the ink.

<Overlap Area in Inkjet Head and Between-Modules Depositing Positional Displacement Shift Amount>

Next, a description is given of an overlap area between the head modules adjacent to each other. Portion (a) of FIG. 7 is a diagram illustrating an example of an array of the nozzles 24 in the overlap area (overlapping area) 26 between the head modules 22-*i* and 22-(*i*+1) adjacent to each other, and here, the nozzles 24 are illustrated in a see-through manner with the head 20 seen from the upper side in a vertical direction (Z direction).

Figure 7:
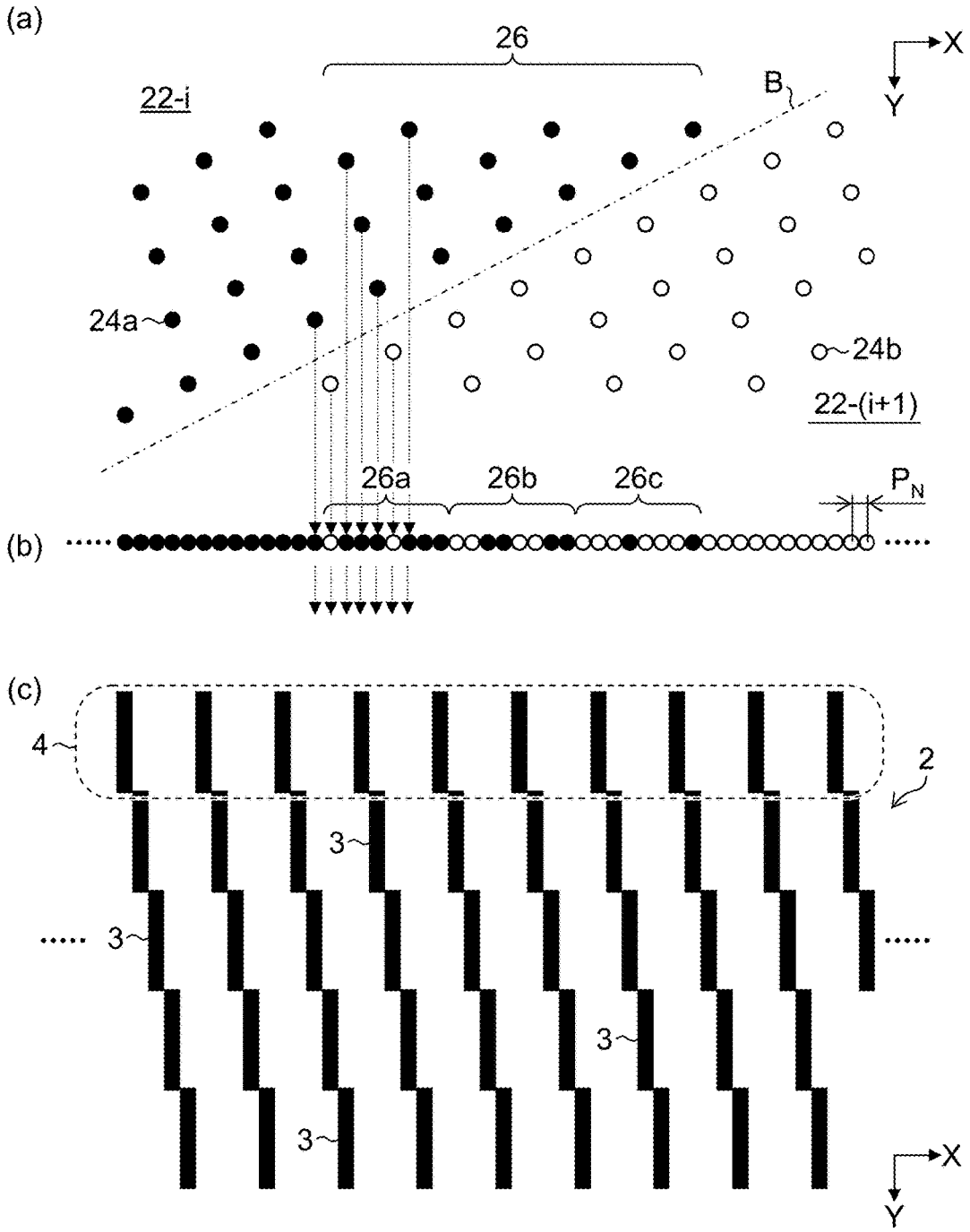
FIG. 7 is a diagram illustrating an overlap area between the head modules adjacent to each other.

In Portion (a) of FIG. 7, nozzles 24*a* each illustrated by a black circle are nozzles belonging to the head module 22-*i*, and nozzles 24*b* each illustrated by a white circle are nozzles belonging to the head module 22-(*i*+1). A dot-and-dash line B represents a boundary between the head module 22-*i* and the head module 22-(*i*+1).

Portion (b) of FIG. 7 is a diagram illustrating a group of projected nozzles in which the nozzles 24*a* and 24*b* illustrated in Portion (a) of FIG. 7 are projected so as to be aligned along the X direction. As described above, the nozzles 24 can be regarded in the same way as they are arrayed linearly at the pitch $P_N$ in the X direction. Here, the projected nozzles are aligned in the X direction at 1200 (dpi (dot per inch)).

As illustrated in Portion (b) of FIG. 7, the projected nozzle group in the overlap area 26 includes the projected nozzles of the nozzles 24*a* and the projected nozzles of the nozzles 24*b* in a mixed manner, and their existing ratios change in a 4-nozzle cycle. In other words, from the left side in the figure, there are in an overlap area 26*a* 2 cycles of regions each constituted by three projected nozzles of the nozzles 24*a* and one projected nozzle of the nozzle 24*b*, and then, there are in an overlap area 26*b* 2 cycles of regions each constituted by two projected nozzles of the nozzles 24*a* and two projected nozzles of the nozzles 24*b*, and further, there are in an overlap area 26*c* 2 cycles of regions each constituted by one projected nozzle of the nozzle 24*a* and three projected nozzles of the nozzles 24*b*.

In such a manner, the projected nozzle group illustrated in Portion (b) of FIG. 7 has the existing ratio of the projected nozzles of the nozzles 24*a* gradually decreasing and the existing ratio for the nozzles 24*b* gradually increasing from the left side toward the right side in the figure.

Portion (c) of FIG. 7 is a diagram illustrating an example of an analysis chart recorded on the paper sheet 1 by the nozzles 24 illustrated in Portion (a) of FIG. 7. An analysis chart 2 has n tiers of bands 4 arranged in the Y direction, each band 4 being a region where plural lines 3 are arranged at spacing of $n \times P_N$ in the X direction. Positions where the lines 3 are arranged are shifted in the X direction by $P_N$ between these n tiers of regions (so-called a "1 on (n−1) off" pattern). Here, a case of n=5 ("1 on 4 off" pattern) is illustrated and this pattern is called an n-division pattern. In the embodiment, the analysis chart 2 like this is used to detect the displacement amounts of the head module 22-*i* and the head module 22-(*i*+1) in the X direction (between-modules depositing positional displacement shift amount).

Figure 8:
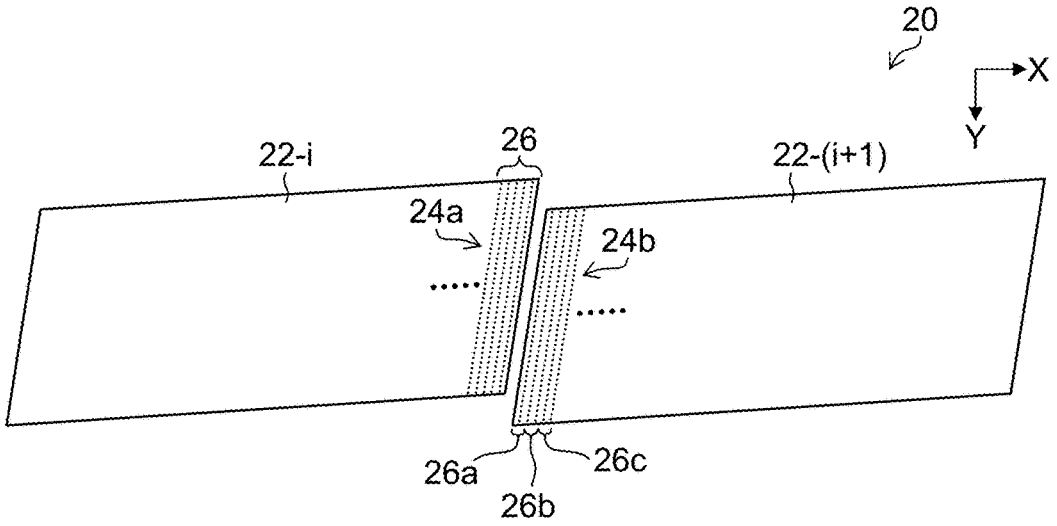
FIG. 8 is a diagram illustrating the overlap area.

FIG. 7 is a diagram used for illustrating the overlap area, and the head 20 according to the embodiment has the overlap area illustrated in FIG. 8.

FIG. 8 is a diagram illustrating the overlap area 26 between the head modules 22-*i* and 22-(*i*+1) adjacent to each other in the head 20 according to the embodiment. Here, the nozzles 24*a* of the head module 22-*i* and the nozzles 24*b* of the head module 22-(*i*+1) are illustrated in a see-through manner with the head 20 seen from the upper side in the vertical direction (Z direction).

Figures 9A, 9B, 9C:
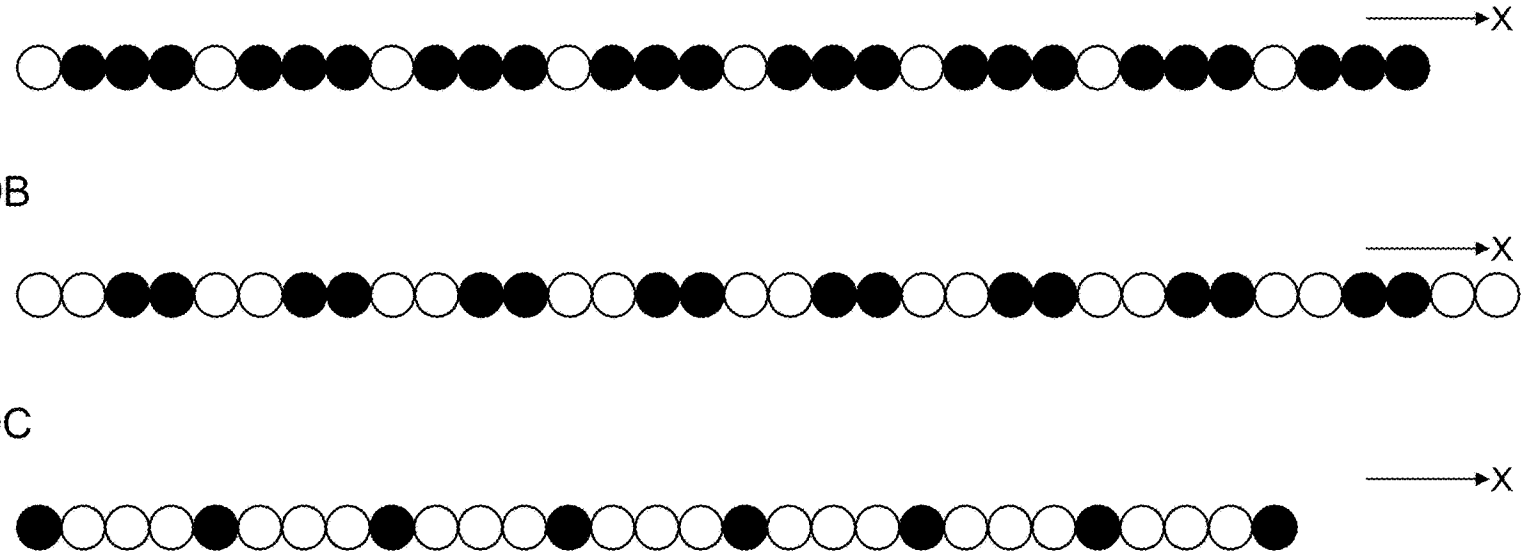
FIGS. 9A to 9C each are a diagram illustrating a projected nozzle group in which nozzles are projected so as to be aligned along an X direction.
Figures 10A, 10B, 10C, 10D:
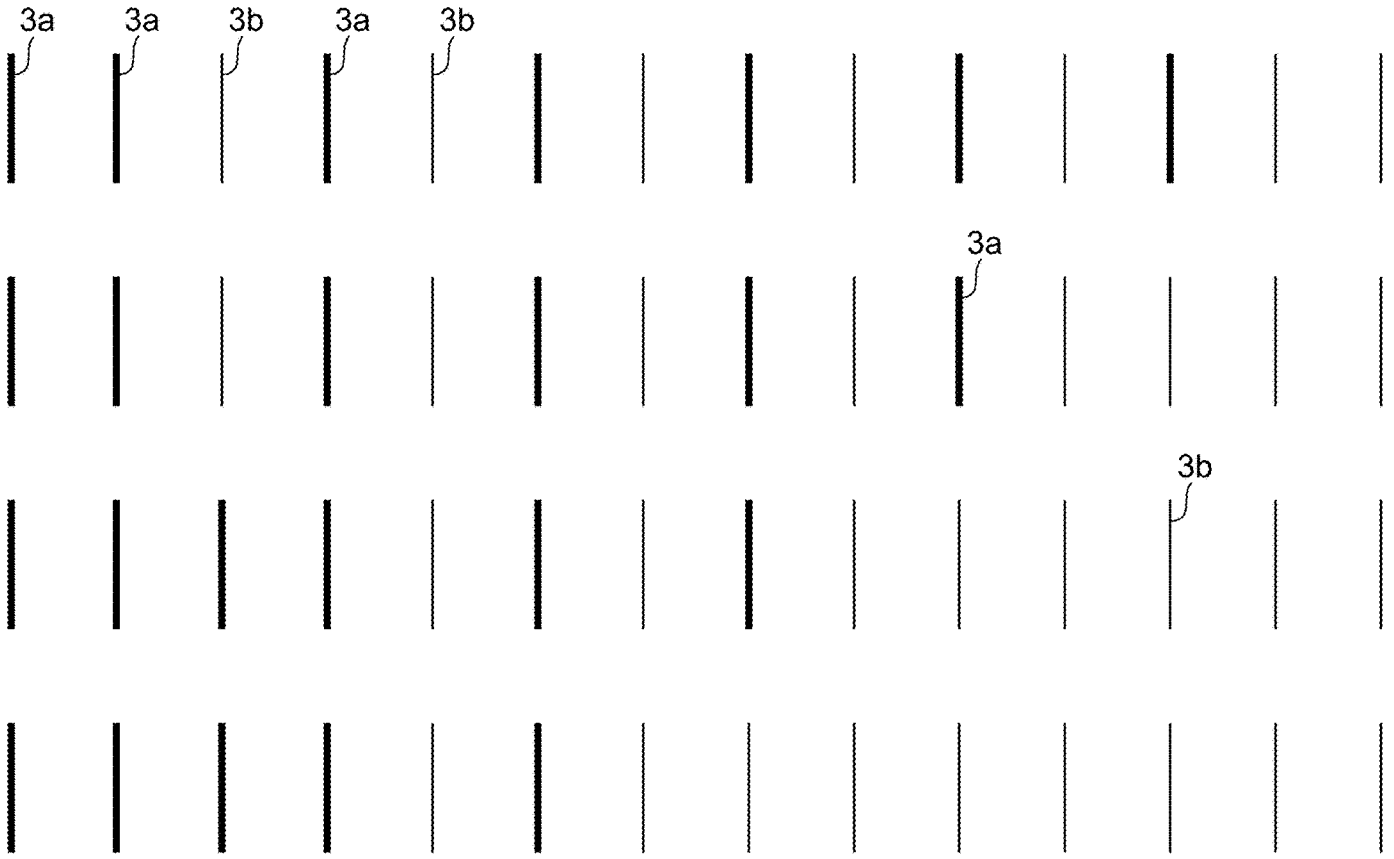
FIGS. 10A to 10D each are a diagram illustrating a pattern of a band drawn by means of the overlap area.

FIGS. 9A to 9C each are a diagram illustrating the projected nozzle group in which the nozzles 24*a* and 24*b* illustrated in FIG. 8 are projected so as to be aligned along the X direction, and a black circle represents a projected nozzle of the nozzle 24*a* and a white circle represents a projected nozzle of the nozzle 24*b*. In FIG. 8, assuming that the overlap areas are designated by 26*a*, 26*b*, and 26*c* from the left side of the overlap area 26, FIG. 9A illustrates the projected nozzles in the overlap area 26*a*, FIG. 9B illustrates the projected nozzles in the overlap area 26*b*, and FIG. 9C illustrates the projected nozzles in the overlap area 26*c*.

As illustrated in FIGS. 9A to 9C, there are in the overlap area 26*a* 8 cycles of regions each constituted by three projected nozzles of the nozzles 24*a* and one projected nozzle of the nozzle 24*b*, there are in the overlap area 26*b* 8.5 cycles of regions each constituted by two projected nozzles of the nozzles 24*a* and two projected nozzles of the nozzles 24*b*, and there are in the overlap area 26*c* 7 cycles of regions each constituted by one projected nozzle of the nozzle 24*a* and three projected nozzles of the nozzles 24*b*.

When an analysis chart for a 10-division pattern, for example, is recorded by the head 20 having the overlap area 26 like this, the individual bands 4 may be classified into four patterns as illustrated in FIGS. 10A to 10D. In the figure, a line image illustrated in a thick line is a line 3*a* recorded by the nozzle 24*a*, and a line image illustrated in a thin line is a line 3*b* recorded by the nozzle 24*b*. In FIGS. 10A to 10D, the lines 3*a* and 3*b* are illustrated with their thicknesses differentiated from each other for the purpose of illustration, but are actually recorded in the same thickness.

FIGS. 10A to 10D respectively illustrate a band 4 of A type in which the line 3*a* and the line 3*b* are replaced with each other five times, a band 4 of B type in which the line 3*a* and the line 3*b* are replaced with each other four times, a band 4 of C type in which the line 3*a* and the line 3*b* are replaced with each other two times, and a band 4 of D type in which the line 3*a* and the line 3*b* are replaced with each other one time.

Here, a depositing position of an ink droplet ejected from the nozzle 24 is displaced from a position where the ink droplet should be deposited, which is called a depositing positional displacement, and an amount of this displacement is called a depositing positional displacement amount (depositing positional error) in the embodiment. Of the depositing positional displacement amounts, a displacement amount in the X direction caused by the positional displacement between the head modules 22 adjacent to each other is called a between-modules depositing positional displacement shift amount.

In the technology described in Japanese Patent Application Laid-Open No. 2014-083720, if the between-modules depositing positional displacement shift amount between the head module 22-*i* and the head module 22-(*i*+1) occurs such that the line 3*a* crosses over the adjacent line 3*b*, the depositing positional error cannot be accurately calculated, and thus, the between-modules depositing positional displacement shift amount cannot be measured. This corresponds to a case where the between-modules depositing positional displacement shift amount more than about 212 (μm) occurs, if a recording resolution of the head 20 is 1200 (dpi) and the analysis chart 2 is the 10-division pattern.

There may be a case where the depositing positional error cannot be accurately calculated due to an effect of a readout resolving capability of the scanner 50 (see FIG. 1).

Figure 11B:
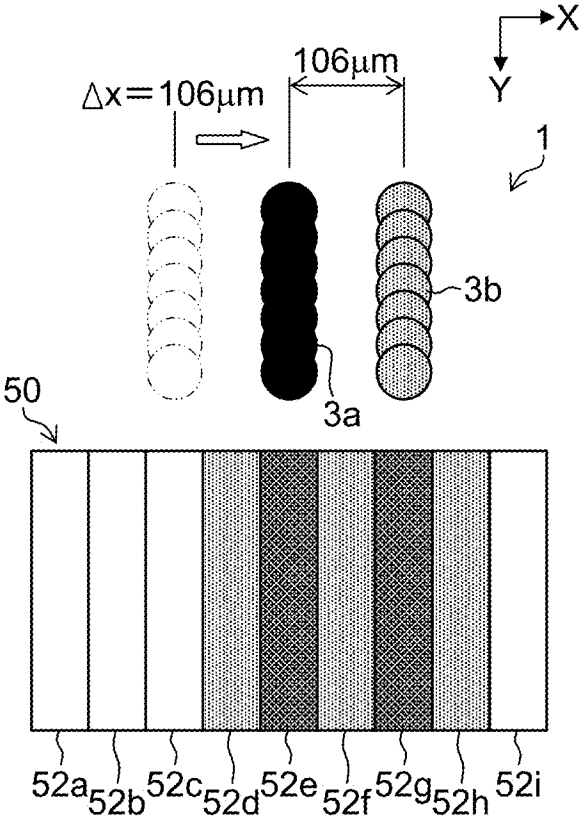
FIGS. 11A and 11B each are a schematic view illustrating a situation where lines recorded by nozzles are read out by a scanner.
Figure 11A:
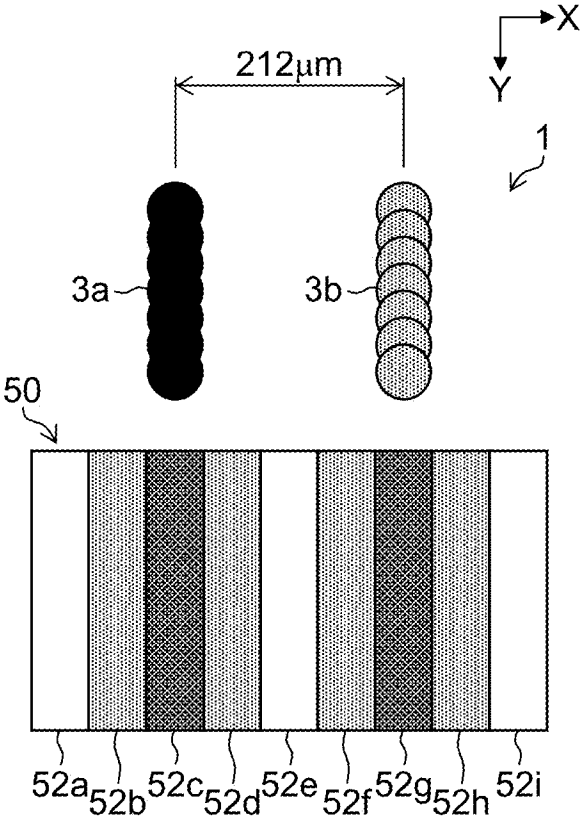

FIGS. 11A and 11B each are a schematic view illustrating a situation where the line 3*a* recorded by the nozzle 24*a* (see FIG. 8) and the line 3*b* recorded by the nozzle 24*b* (see FIG.

8) in the overlap area 26 are read out by means of pixels 52*a* to 52*i* of the scanner 50. Here, the readout resolving capability of the scanner 50 is 480 (dpi), and an interval of the pixels adjacent to each other is 53 (μm). The lines 3*a* and 3*b* each are a line of the 10-division pattern and have widths in the X direction (diameter of a dot) of about 43 (μm).

FIG. 11A illustrates a case where the between-modules depositing positional displacement shift amount is Δx=0 (μm), with spacing between the line 3*a* and the line 3*b* being 212 (μm). In this case, the line 3*a* is read out by means of the pixels 52*b* to 52*d* with the pixel 52*c* being the center, and the line 3*b* is read out by means of the pixels 52*f* to 52*h* with the pixel 52*g* being the center. In this way, the width of each of the lines 3*a* and 3*b* in the X direction is smaller than that of one pixel of the scanner 50, but an effect of a read signal reaches the pixel adjacent to the center pixel due to an effect of an optical flare or the like. In the example illustrated in FIG. 11A, since the read signal for the line 3*a* and the read signal for the line 3*b* do not interfere with each other, each of positions of the lines 3*a* and 3*b* can be correctly measured. Therefore, the between-modules depositing positional displacement shift amount can be calculated.

On the other hand, FIG. 11B illustrates a case where the between-modules depositing positional displacement shift amount is Δx=106 (μm), with the spacing between the line 3*a* and the line 3*b* being 106 (μm). In this case, the line 3*a* is read out by means of the pixels 52*d* to 52*f* with the pixel 52*e* being the center, and the line 3*b* is read out by means of the pixels 52*f* to 52*h* with the pixel 52*g* being the center. In this way, if the line 3*a* becomes closer to the line 3*b*, the read signal for the line 3*a* and the read signal for the line 3*b* interfere with each other at the pixel 52*f*, making it inaccurate to measure the positions of the lines 3*a* and 3*b*. As a result, the between-modules depositing positional displacement shift amount cannot be accurately calculated.

As described above, there has been a case where the technology described in Japanese Patent Application Laid-Open No. 2014-083720 cannot measure the between-modules depositing positional displacement shift amount.

<Electrical Configuration of Inkjet Recording Apparatus>

Figure 12:
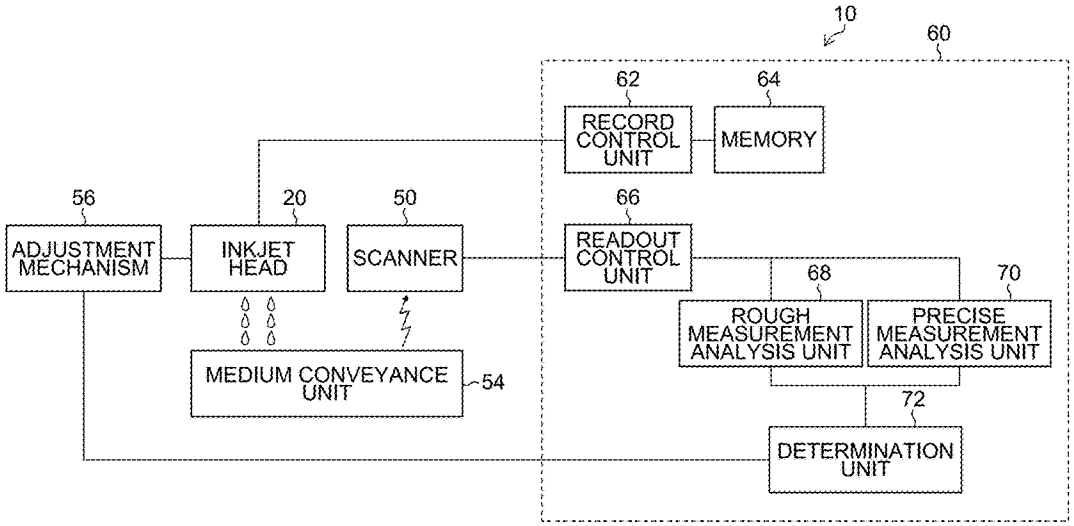
FIG. 12 is a block diagram illustrating an electrical configuration of the inkjet recording apparatus.

FIG. 12 is a block diagram illustrating an electrical configuration of the inkjet recording apparatus 10 according to the embodiment. The inkjet recording apparatus 10 includes, besides the head 20 and scanner 50 described above, a medium conveyance unit 54, an adjustment mechanism 56, and a control unit 60.

The medium conveyance unit 54 (an example of a moving device) conveys and passes the paper sheet 1 in the Y direction with the recording surface of the paper sheet 1 facing the nozzle surface 20A of the head 20 (an example of moving relative to each other).

The adjustment mechanism 56, which includes a motor (not illustrated) moving the n head modules 22-*i* of the head 20 in the X direction with respective orientations of the nozzle surfaces 20A being independently kept constant, adjusts the position of the head modules 22-*i* in the X direction depending on an output from a determination unit 72.

The control unit 60 includes a record control unit 62, a memory 64, a readout control unit 66, a rough measurement analysis unit 68, a precise measurement analysis unit 70, and the determination unit 72.

The record control unit 62 (an example of a first measurement chart recording device, and an example of a second measurement chart recording device) controls the head 20 on the basis of image data stored in the memory 64 to eject the ink from the nozzles 24 of the head modules 22-*i* and record an image on the recording surface of the paper sheet 1. The memory 64 also has stored therein data of a rough measurement chart and precise measurement chart described later.

The readout control unit 66 (an example of a first measurement chart reading-out device and an example of a second measurement chart reading-out device) controls the scanner 50 to acquire read data of the image recorded on the recording surface of the paper sheet 1.

The rough measurement analysis unit 68 (an example of a rough analyzing device) performs rough measurement on the between-modules depositing positional displacement shift amount for the head module 22 on the basis of the read image of the rough measurement chart input from the readout control unit 66. The precise measurement analysis unit 70 (an example of a precise analyzing device) performs precise measurement on the between-modules depositing positional displacement shift amount for the head module 22 on the basis of the read image of the precise measurement chart input from the readout control unit 66.

The determination unit 72 (an example of a measurement result selecting device) determines which of the measurement results the between-modules depositing positional displacement shift amount measured by the rough measurement analysis unit 68 and the between-modules depositing positional displacement shift amount measured by the precise measurement analysis unit 70 should be true, and outputs the between-modules depositing positional displacement shift amount determined to be true to the adjustment mechanism 56.

<Method for Adjusting Inkjet Head>

Figure 13:
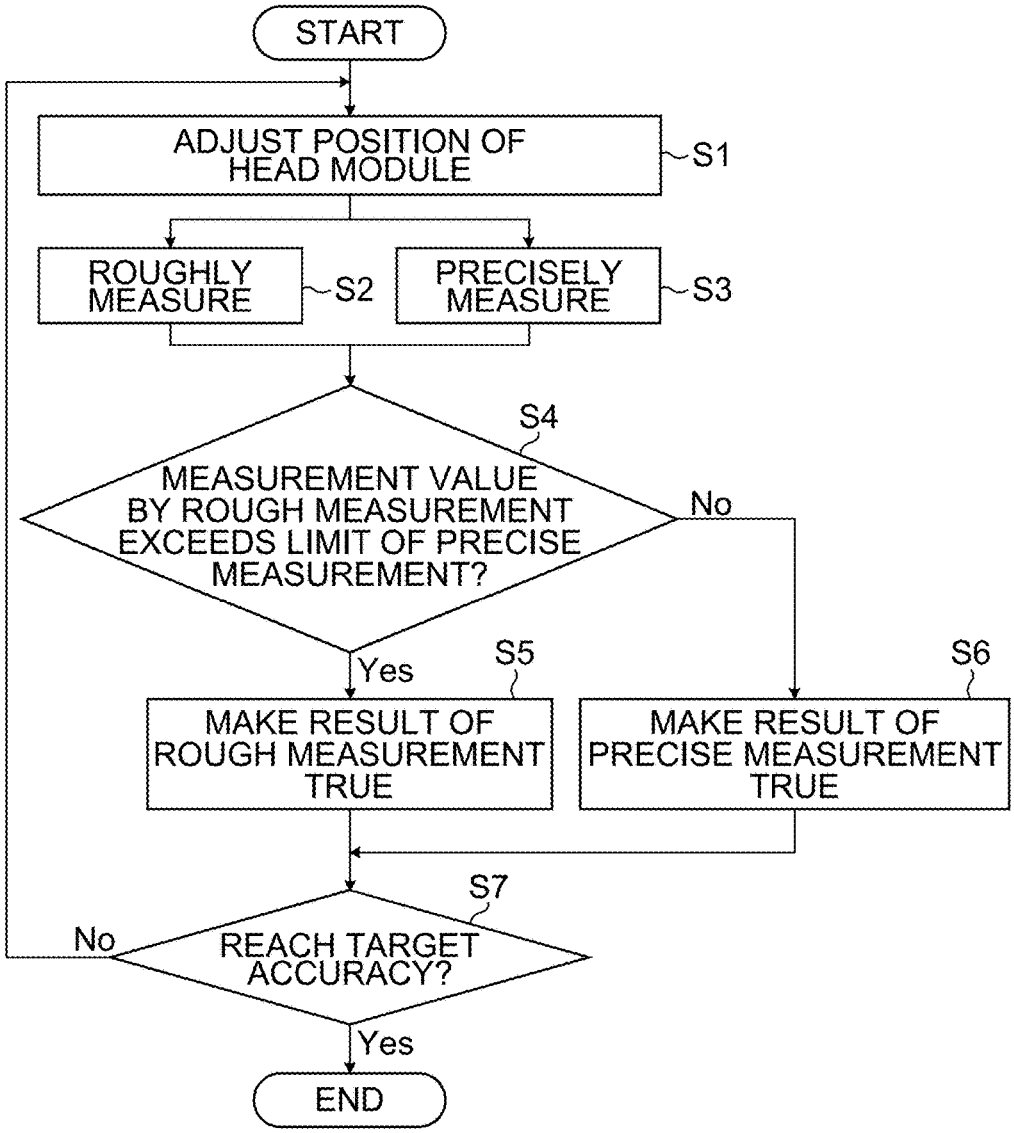
FIG. 13 is a flowchart illustrating an example of a process of a method for adjusting an inkjet head.

Adjustment of the inkjet head according to the embodiment uses in combination a precise measurement scheme of precisely measuring and a rough measurement scheme of roughly measuring in measuring the between-modules depositing positional displacement shift amount. FIG. 13 is a flowchart illustrating an example of a process of a method for adjusting an inkjet head according to the embodiment. Here, a description is given of the adjustment of the head modules 22, particularly, the adjustment of the head module 22-*i* and the head module 22-(*i*+1).

First, physical positions of the head module 22-*i* and the head module 22-(*i*+1) are adjusted (step S1, an example of an adjusting step). At the beginning of the process, the head module 22-*i* and the head module 22-(*i*+1) may be attached to the head 20.

Next, in accordance with the rough measurement scheme and the precise measurement scheme, the between-modules depositing positional displacement shift amount of each of the head module 22-*i* and the head module 22-(*i*+1) is measured. The measurement of the between-modules depositing positional displacement shift amount by the rough measurement scheme is performed by reading out rough measurement chart data from the memory 64 by the record control unit 62, drawing the rough measurement chart (an example of a second measurement chart) on the paper sheet 1 by the head module 22-*i* and the head module 22-(*i*+1) under the control of the record control unit 62, reading out the drawn rough measurement chart by the scanner 50 under the control of the readout control unit 66, and measuring (analyzing) the read data of the rough measurement chart and calculating the between-modules depositing positional displacement shift amount with a rough measurement accuracy (an example of a second arithmetic accuracy) by the rough measurement analysis unit 68 (step S2, an example of a rough analyzing step). Here, the rough measurement accuracy refers to a resolving capability in units of μm.

On the other hand, the measurement of the between-modules depositing positional displacement shift amount by the precise measurement scheme is performed by reading out precise measurement chart data from the memory 64 by the record control unit 62, drawing the precise measurement chart (an example of a first measurement chart) on the paper sheet 1 by the head module 22-*i* and the head module 22-(*i*+1) under the control of the record control unit 62, reading out the drawn precise measurement chart by the scanner 50 under the control of the readout control unit 66, and measuring (analyzing) the read data of the precise measurement chart and calculating the between-modules depositing positional displacement shift amount with a precise measurement accuracy (an example of a first arithmetic accuracy) finer than the rough measurement accuracy by the precise measurement analysis unit 70 (step S3). Here, the precise measurement accuracy refers to a resolving capability in units of (μm).

Figure 14:
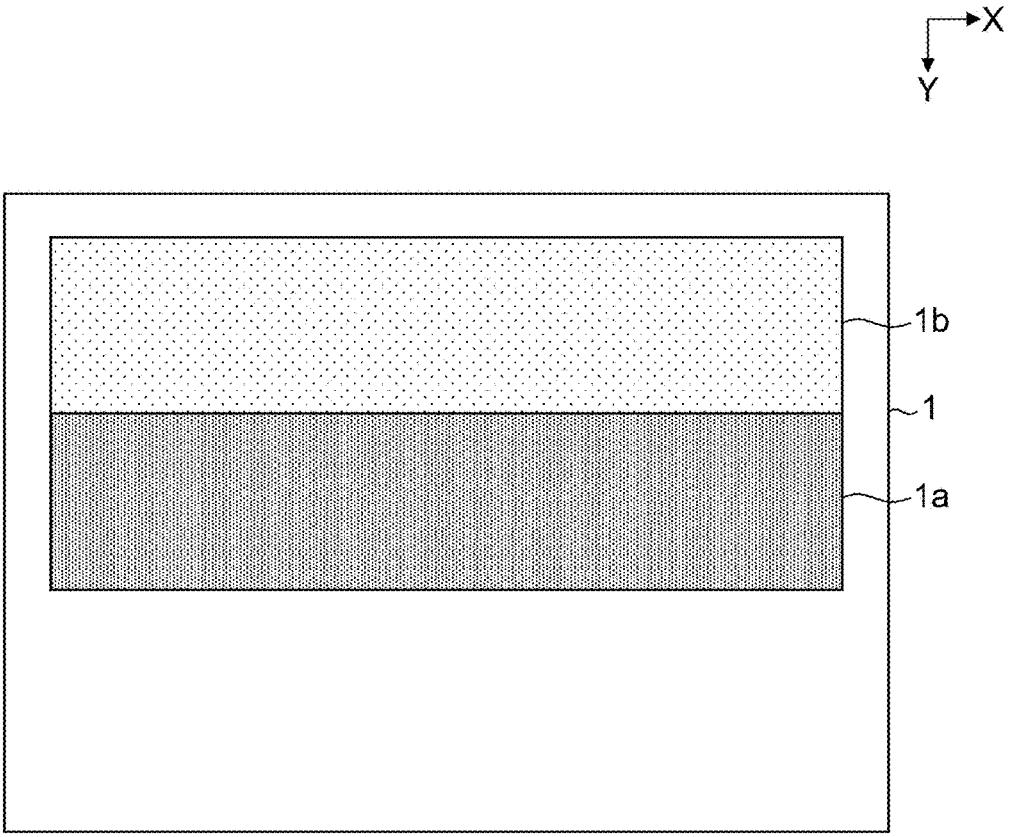
FIG. 14 is a diagram illustrating a rough measurement chart region and precise measurement chart region arranged on a recording surface of a paper sheet.

FIG. 14 is a diagram illustrating a rough measurement chart region 1*a* where the rough measurement chart is drawn and a precise measurement chart region 1*b* where the precise measurement chart is drawn, both of which are arranged on the recording surface of one paper sheet 1. The inkjet recording apparatus 10 draws the rough measurement chart and the precise measurement chart on one paper sheet 1 by the head modules 22 of the head 20 and reads out the rough measurement chart and the precise measurement chart by the scanner 50. This allows the process at step S2 and the process at step S3 to be performed in parallel.

Next, determined is whether or not the rough measurement shift amount measured by the rough measurement analysis unit 68 exceeds a measurable region for the precise measurement analysis unit 70 (an example of a first dynamic range) (step S4). The measurable region refers to a measurable range from a minimum value to maximum value (range of possible measurement values) and the rough measurement shift amount and the measurable region are in units of μm. If exceeding, the rough measurement shift amount measured by the rough measurement analysis unit 68 is set to the between-modules depositing positional displacement shift amount (step S5, an example of a measurement result selecting step), and if the measurable region for the precise measurement analysis unit 70 is not exceeded (an example of a case of being within the first dynamic range), the precise measurement shift amount measured by the precise measurement analysis unit 70 is set to the between-modules depositing positional displacement shift amount (step S6, an example of a measurement result selecting step).

Subsequently, determined is whether or not the determined between-modules depositing positional displacement shift amount reaches a target accuracy, that is, whether or not it falls within a threshold (step S7). If falling within the threshold, the adjustment of the physical positions of the head module 22-*i* and the head module 22-(*i*+1) is ended.

If not falling within the threshold, the process returns to step S1, the physical positions of the head module 22-*i* and the head module 22-(*i*+1) are adjusted by the adjustment mechanism 56 on the basis of the determined between-modules depositing positional displacement shift amount. For example, if the between-modules depositing positional displacement shift amount has a positive value, the head module 22-*i* and the head module 22-(*i*+1) are made to move closer to the X direction by an absolute value of the relevant amount, and if the between-modules depositing positional displacement shift amount has a negative value, the head module 22-*i* and the head module 22-(*i*+1) are made to move farther from the X direction by an absolute value of the relevant amount.

After adjusting the physical positions, the process at step S2, and the process at step S5 and subsequent steps are performed similarly.

Step S2 to step S7 constitute a method for analyzing the positional displacement between the head modules. The method for analyzing a positional displacement between head modules and the method for adjusting an inkjet head may be configured as a program for causing a computer to implement the above steps (an example of a program for analyzing a positional displacement between the head modules) to configure a non-transitory recording medium storing the program such as a CD-ROM (Compact Disk-Read Only Memory).

<Detail of Rough Measurement Scheme>

Figure 15:
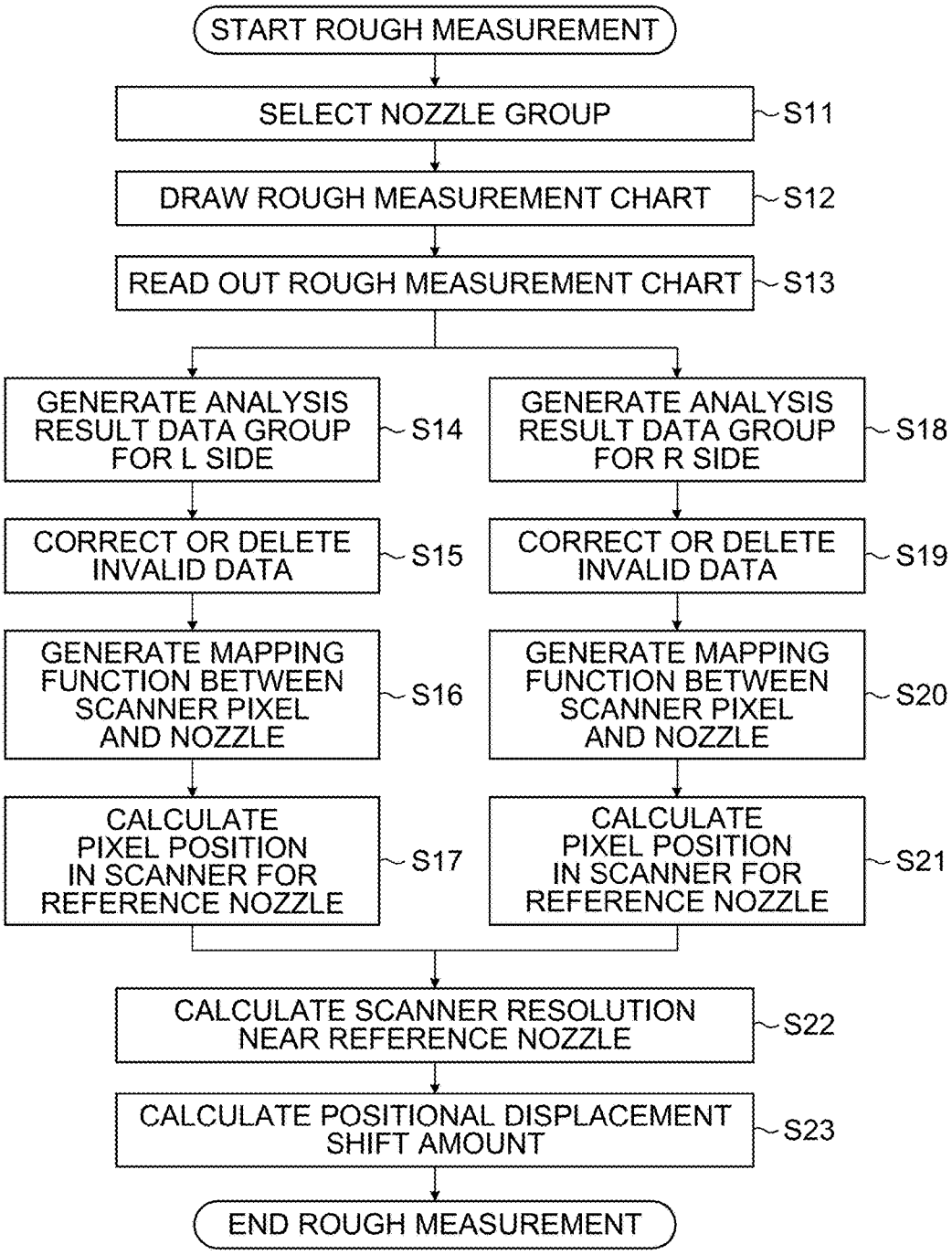
FIG. 15 is a flowchart illustrating a process for a rough measurement scheme.

Next, a description is given of a detail of the process for the rough measurement at step S2 in FIG. 13 using a flowchart illustrated in FIG. 15.

First, the nozzle group for drawing the rough measurement chart is selected (step S11). At this step, first, a reference nozzle for calculating the between-modules depositing positional displacement shift amount is determined for each of the head module 22-*i* and the head module 22-(*i*+1) adjacent to each other from among the plural nozzles 24 of the both head modules. Then, the nozzles 24 near the respective reference nozzles (plural nozzles 24 adjacent to each other in the X direction) are determined, the nozzles 24 being used for drawing the rough measurement chart. These nozzles are collectively referred to as a reference nozzle group.

The reference nozzle may be represented by a virtual value having a value after the decimal point. For example, a nozzle between the 10th nozzle 24 and the 11th nozzle 24 from an end in the X direction, that is, the 10.5th nozzle may be a used as a reference.

Figure 16:
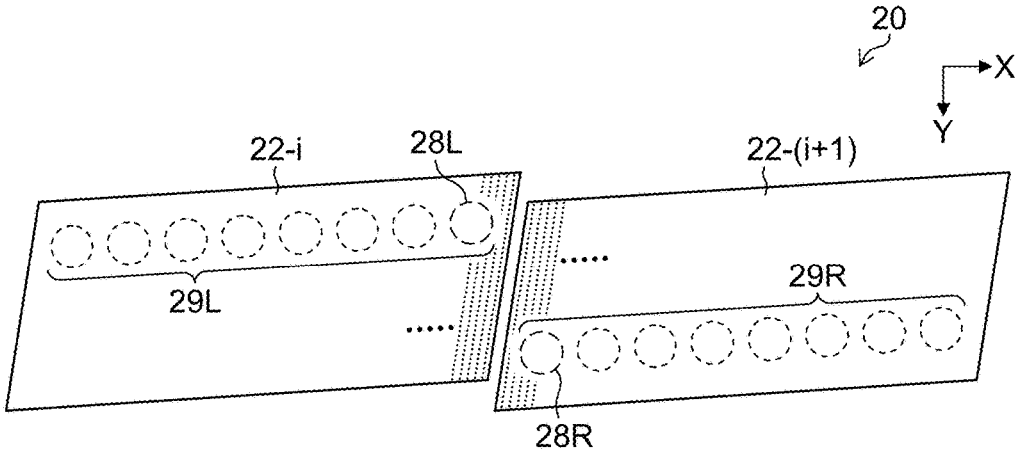
FIG. 16 is a diagram illustrating an example of a chart drawing nozzle group.

Next, a chart drawing nozzle group (an example of a plurality of predefined recording elements) is selected for each of the head module 22-*i* and the head module 22-(*i*+1). The chart drawing nozzle group includes the reference nozzle group and is a nozzle group for drawing a plurality of patterns (an example of a plurality of line images), each of the plurality of patterns being the same as the pattern drawn by the reference nozzle group. FIG. 16 is a diagram illustrating an example of a chart drawing nozzle group 29L including a reference nozzle group 28L of the head module 22-*i* and a chart drawing nozzle group 29R including a reference nozzle group 28R of the head module 22-(*i*+1). In the example illustrated in the figure, the chart drawing nozzle groups 29L and 29R are selected at a regular interval in the X direction, but the interval in the X direction may not be regular.

Figure 17A:
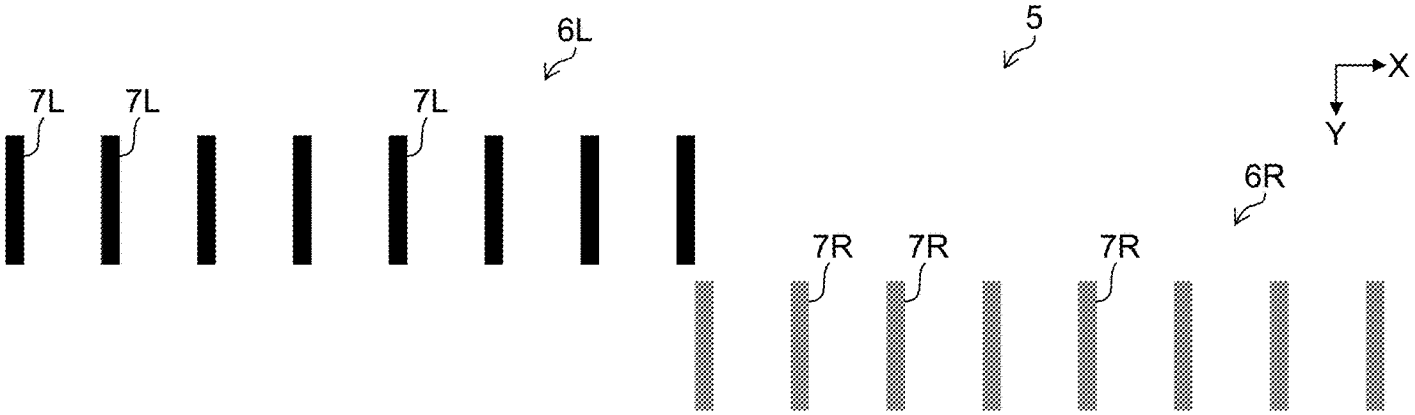
FIGS. 17A and 17B each are a diagram illustrating an example of a rough measurement chart.
Figure 17B:
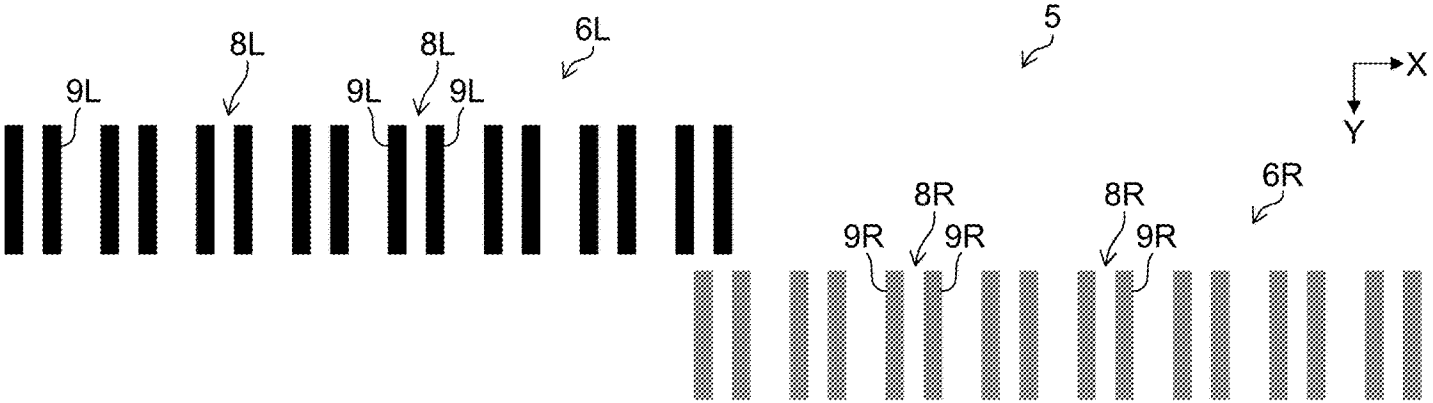

Next, the rough measurement chart is drawn on the recording surface of the paper sheet 1 by the chart drawing nozzle groups 29L and 29R selected at step S11 (step S12, an example of a second measurement chart recording step). FIGS. 17A and 17B illustrate an example of a rough measurement chart 5. The rough measurement chart 5 is a line image group drawn by the chart drawing nozzle groups 29L and 29R, and FIG. 17A illustrates the rough measurement chart 5 which has a chart 6L including plural lines 7L drawn by the chart drawing nozzle group 29L and a chart 6R including plural lines 7R drawn by the chart drawing nozzle group 29R. Each of the lines 7L and lines 7R is a line image extending in the Y direction and has a thickness in the X direction.

FIG. 17B illustrates the rough measurement chart 5 which has a chart 6L including lines 9L drawn by the chart drawing nozzle group 29L and a chart 6R including lines 9R drawn by the chart drawing nozzle group 29R. The lines 9L and lines 9R are arranged in pairs with a region 8L between two lines 9L and a region 8R between two lines 9R, and each of lines 9L and lines 9R has a thickness in the X direction and is a line image extending in the Y direction. A distance between two lines 9L (9R) in the X direction is necessary to be separated from each other to such an extent that the read signals for the pixels of the scanner 50 do not interfere with each other for the same reason described using FIGS. 11A and 11B.

Here, in the rough measurement chart 5, the chart 6L drawn by the chart drawing nozzle group 29L of the head module 22-*i* and the chart 6R drawn by the chart drawing nozzle group 29R of the head module 22-(*i*+1) are independently drawn. The lines 7L and 7R and the lines 9L and 9R are drawn by the chart drawing nozzle groups 29L and 29R selected at step S1, and the positions of the nozzles 24 in the X direction of the chart drawing nozzle groups 29L and 29R are known.

It is important that, in order to improve a measurement accuracy for the between-modules depositing positional displacement shift amount, the thickness of the line image of the rough measurement chart in the X direction (length in the X direction) is thicker than the width of one pixel of the scanner 50 in the X direction (that is, longer than the length of one pixel of the scanner 50 in the X direction). The lines 7L and 7R, and the lines 9L and 9R according to the embodiment are drawn to be thicker than the width of one pixel of the scanner 50 in the X direction by use of the chart drawing nozzle groups 29L and 29R including the plural nozzles 24 adjacent to each other in the X direction.

Next, the rough measurement chart 5 drawn on the recording surface of the paper sheet 1 at step S12 is read out by the scanner 50 (step S13, an example of a second measurement chart reading-out step).

Further, the read data of the rough measurement chart 5 is analyzed. The rough measurement chart 5 is analyzed at steps S14 to S17 for the chart 6L and at steps S18 to S21 for the chart 6R. Here, a description is given of a case where the rough measurement chart 5 illustrated in FIG. 17B is used.

In analyzing the read data of the chart 6L, first, an analysis result data group for the chart drawing nozzle group 29L is generated (step S14). Here, regarding the region 8L between each of the pairs of two lines 9L, a gravity center pixel position in the scanner 50 is measured. The gravity center pixel position is calculated to decimal places. Then, the calculated gravity center pixel position is associated with center nozzle information of the region 8L determined from positional information on the chart drawing nozzle group 29L to give a correspondence relationship. These are defined as the analysis result data group.

Next, invalid data is corrected or deleted from the analysis result data group (step S15). For example, if there is data improper for analyzing such as that a proper line 9L is not drawn or the like, the data is corrected or deleted. In particular, in the case of recording in the single-pass printing as in the embodiment, if there is a defective nozzle such as a nozzle not ejecting the ink (no-ejecting nozzle), a streak-like white blank is generated in the recorded image. Therefore, in a case where the thickness of the line 9L (width in the X direction) is changed due to the defective nozzle, the influence is taken into consideration to perform the correction process on the correspondence relationship between the gravity center pixel position and the center nozzle information. If an ejection condition dose not reach such an extent that the correction can be performed, that analysis result data is subjected to a deletion process.

Subsequently, a mapping function between a scanner pixel and nozzle is generated by applying a least-square technique (an example of a mapping function between a position of a read pixel of the reading-out device in the first direction and a position of the recording element in the first direction) from data of the correspondence relationship between the information on the gravity center pixel position in the scanner 50 for each region 8L and the center nozzle information of the region 8L included in the analysis result data group having subjected to the correction process or deletion process on the invalid data (step S16). A regression equation in the least-square technique may be a primary expression, but in a case where locality is caused in the readout resolving capability due to optical performance of the scanner 50 (particularly, distortion occurrence), a quadratic or higher expression may be effectively used.

Next, the mapping function between the scanner pixel and nozzle determined at step S16 is used to anew calculate the pixel position in the scanner 50 for the reference nozzle group 28L (step S17).

Similarly to analyzing the read data of the chart 6L, the read data of the chart 6R is analyzed at step S18 to S21. This allows the pixel position in the scanner 50 for the reference nozzle group 28R to be calculated. The analysis of the read data of the chart 6L and the analysis of the read data of the chart 6R may be performed in parallel.

After completing the analysis of the read data of the charts 6L and 6R respectively, then, from the mapping function between the scanner pixel and nozzle determined at step S16 and step S20, the readout resolving capability of the scanner 50 near each of the reference nozzle groups 28L and 28R is determined (step S22). If an optical accuracy of the scanner 50 is reliable, this step may be omitted. If no reliable, from a slope information of the mapping function between the scanner pixel and nozzle, which is equivalent to the locality information of the readout resolving capability of the scanner 50, the readout resolving capability of the scanner 50 near the reference nozzle groups 28L and 28R is calculated. Here, an average of the readout resolving capability of the scanner 50 near the reference nozzle group 28L which is calculated from the mapping function between the scanner pixel and nozzle determined at step S16 and the readout resolving capability of the scanner 50 near the reference nozzle group 28R which is calculated from the mapping function between the scanner pixel and nozzle determined at step S20 is used as the readout resolving capability of the scanner 50.

Finally, the between-modules depositing positional displacement shift amount between the head module 22-*i* and the head module 22-(*i*+1) is calculated as the rough measurement shift amount (step S23, an example of a rough analyzing step). Here, from the information on the pixel position in the scanner 50 for the reference nozzle groups 28L and 28R obtained at steps S17 and S21, and the information on the readout resolving capability of the scanner 50 obtained at step S22, an actual measured value of a distance between the reference nozzle group 28L and the reference nozzle group 28R is determined to subtract from the determined actual measured value a design value of a distance between the reference nozzle group 28L and the reference nozzle group 28R. This allows the rough measurement shift amount to be determined.

The pixel position in the scanner 50 for each of the reference nozzle groups 28L and 28R is calculated from the information on the plural lines 9 (the region 8) at steps S17 and S21, but this information can be basically calculated so long as the line image is drawn only at the position of each of the reference nozzle groups 28L and 28R. In the embodiment, the plural lines 9 are consciously drawn by the chart drawing nozzle groups 29L and 29R redundantly. This is because the ejection condition of the reference nozzle groups 28L and 28R may be possibly low and an appropriate evaluation may not be possibly given in this case, and a manufacturing accuracy of the head modules 22-*i* and 22-(*i*+1), which is reliable, is used as priori information to reduce a measurement noise.

<Detail of Precise Measurement Scheme>

Figure 18:
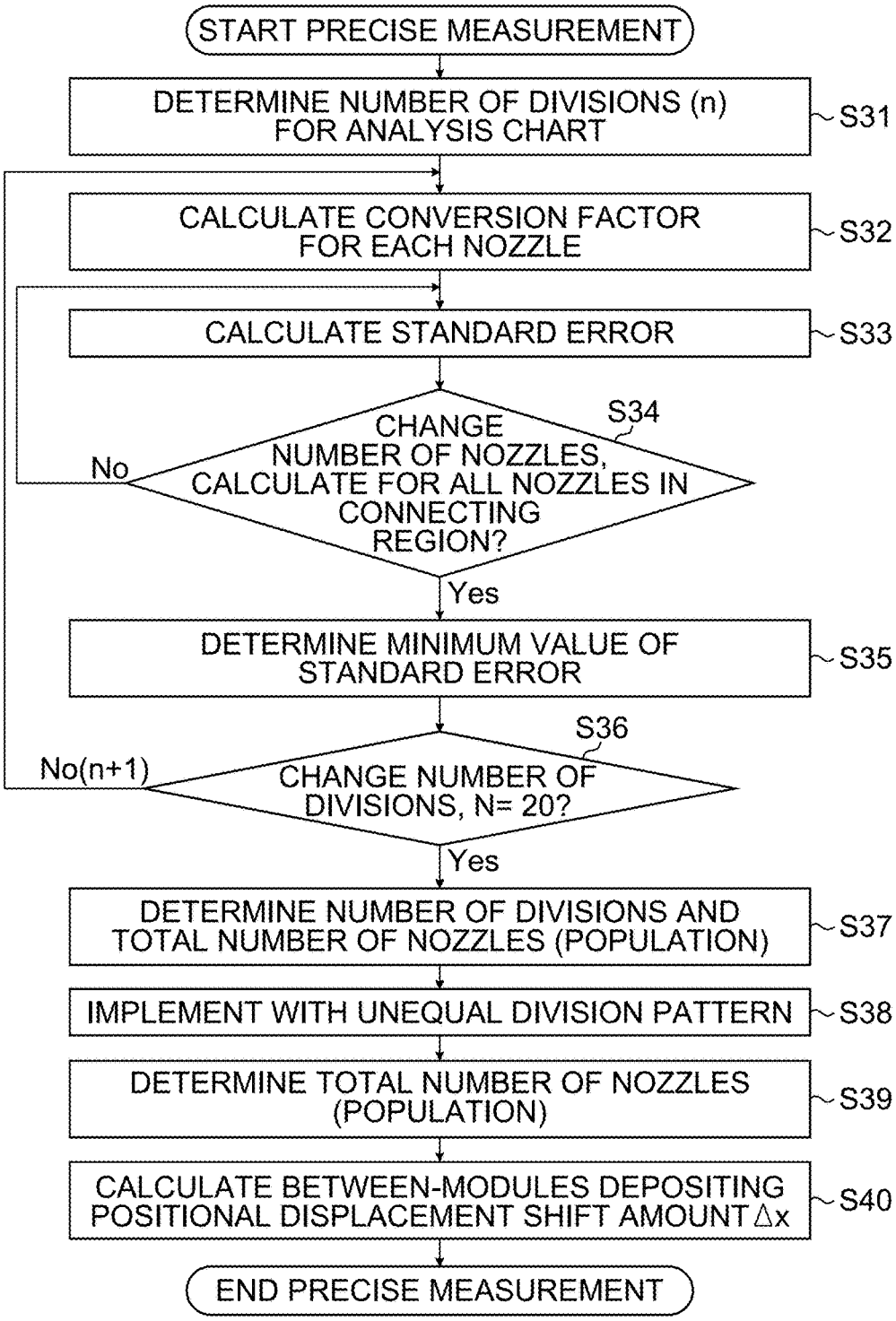
FIG. 18 is a flowchart illustrating a process for a precise measurement scheme.

Next, a description is given of a detail of the precise measurement scheme using a flowchart illustrated in FIG. 18.

First, an arbitrary number n as the number of divisions is determined, and the precise measurement chart for the n-division pattern is recorded on the recording surface of the paper sheet 1 (step S31, an example of a first measurement chart recording step). The analysis chart 2 described above illustrated in Portion (c) of FIG. 7 is the precise measurement chart for a 5-division pattern. As illustrated in FIG. 14, the precise measurement chart and the rough measurement chart are recorded on the same one paper sheet 1. In other words, this process at step S31 and the process at step S2 illustrated in FIG. 15 are performed on one paper sheet 1.

If the number n of divisions is too small, as is described using FIGS. 11A and 11B, the depositing positional error cannot be accurately calculated due to the effect of the readout resolving capability of the scanner 50. If the number n of divisions is large, a length of the analysis chart 2 in the Y direction is elongated, which is not preferable. Additionally, even if the number n of divisions is increased, the measurement accuracy does not increase. In the case of the head 20 having the recording resolution of 1200 (dpi), it may be sufficient to discuss with equally dividing from 8-division to 12-division.

Next, the precise measurement chart drawn on the recording surface of the paper sheet 1 is read out by the scanner 50 (an example of a first measurement chart reading-out step) to calculate a conversion factor for each nozzle depending on the number n of divisions (step S32). As premises for calculation of the conversion factor, (1) the depositing positional displacement for one head module is displaced (shifted) with respect to the depositing positional displacement for the other module by +Δx in the X direction, and (2) the random depositing positional displacement amount is calculatedly assumed to be zero.

Figure 19A:
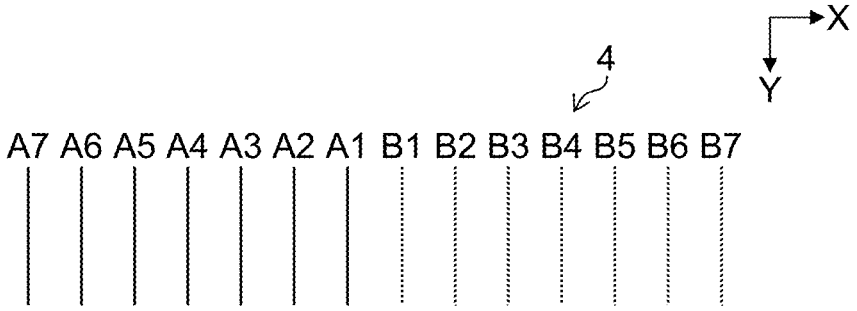
FIGS. 19A and 19B each are a diagram illustrating a band of an analysis chart.

FIG. 19A is a diagram illustrating the band 4 of the analysis chart for a 12-division pattern, and illustrates the line alignment in a portion drawn by the nozzles 24 in the overlap area 26. Lines A1 to A7 and lines B1 to B7 illustrated in the figure correspond to the lines 3 illustrated in Portion (c) of FIG. 7, and the lines A1 to A7 are lines drawn by the head module 22-*i* and the lines B1 to B7 are lines drawn by the head module 22-(*i*+1).

Figure 19B:
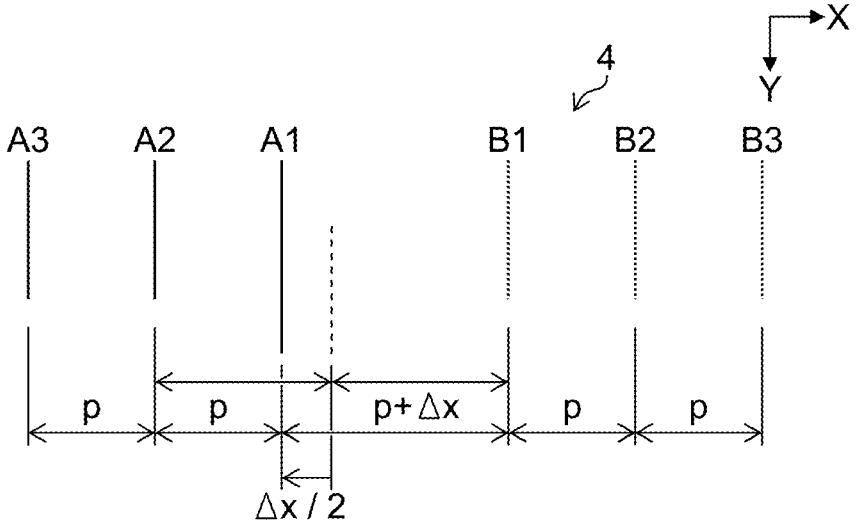

FIG. 19B is a partially enlarged view of FIG. 19A. the spacing between the lines drawn by the nozzles 24 of the same head module is $p=12\times P_N$, but if there is the between-modules depositing positional displacement shift amount Δx between the head module 22-*i* and the head module 22-(*i*+1), spacing between the line A1 and the line B1 is $12\times P_N+\Delta x$.

Hereinafter, a description is given of a method for calculating the conversion factor using FIG. 19B.

In a case where a conversion factor of a certain nozzle 24 is determined (the nozzle 24 drawing the line A1 in the embodiment), plural lines on both sides of the line A1 are used to make an approximate curve for examining a position where the line A1 should be positioned (a position where the nozzle 24 drawing the line A1 should be positioned). Here, 15 lines on both sides of the nozzle 24 of which the conversion factor is to be determined are used to make an approximate curve, and the position where the line A1 should be positioned (depositing positional displacement amount) is examined. For example, in a case where the depositing positional displacement amount of the nozzle 24 drawing the line A1 is calculated, 15 lines on both sides of the line A1, that is, used are 30 lines of A16, A15, A14, . . . , A4, A3, A2, B1, B2, B3, . . . , B13, B14, and B15.

FIG. 20A illustrates a relationship between a nozzle number and a coordinate used for creating an approximate curve of the line A1, and FIG. 20B illustrates a relationship between a nozzle number and a coordinate used for creating an approximate curve of the line A2. In FIGS. 20A and 20B, the leftmost one of the lines for creating the approximate curve is described as a nozzle #1. Therefore, FIG. 20A and FIG. 20B are different in the nozzle numbers and the nozzle positions. In the table, reference character p represents the 12-division pattern of 1200 (dpi) in the embodiment, and thus, the calculation is carried out with $p=12\times P_N=254$ (μm). The calculation is carried out assuming that the between-modules depositing positional displacement shift amount Δx is 1 (μm). In determining the conversion factor, since Δx is divided by the depositing positional displacement amount, the same result is obtained even if any value is used as Δx.

In this way, 30 lines are used to create the approximate curve for examining the position where the line A1 should be positioned. When creating the approximate curve, if the position where the line A1 should be positioned is determined, it is determined without using a coordinate of the line A1 for the calculation. The calculation results in that the position where the line A1 should be positioned is −0.5 (μm), and since the line A1 is actually positioned at a coordinate 0, the depositing positional displacement amount is −0.5 (μm) due to an influence of Δx=1 (μm).

The between-modules depositing positional displacement shift amount Δx can be determined in accordance with Δx=conversion factor×depositing positional displacement amount, and thus, conversion factor of line A1=Δx÷(−0.5)=1÷(−0.5) is determined to give "−2".

Similarly, as for the line A2, a position where the line A2 should be positioned is −0.43 (μm), and the depositing positional displacement amount is −0.43 (μm), and therefore, the conversion factor of the line A2 is Δx÷(−0.43)=1÷(−0.43)=−2.48.

Similarly, as for the line A3, line A4, line B1, line B2, line B3, and line B4, 15 lines on both sides of the line of interest, that is, 30 lines in total are used to determine the conversion factor.

FIG. 21 illustrates a result of the determined conversion factors. In the case of the 12-division pattern, since only the line alignment illustrated in FIG. 19A is given, the line A1 and the line B1 have the conversion factors inverse in sign and are symmetry.

This conversion factor is used to examine the nozzles used for calculating the standard error.

Next, the total number of nozzles used for the calculation (population) is determined in ascending order of the conversion factors calculated at step S32 to calculate the standard error (step S33). The standard error can be determined in accordance with the next formula.

(Standard error)=(average of conversion factors)×
(random depositing positional displacement σ)÷
(√total number of nozzles used for calculation) (Formula 1)

The minimum value of the total number of nozzles is determined depending on the number of the lines with the minimum conversion factor. The random depositing positional displacement σ is a standard deviation σ of the depositing positional displacement amounts for the number of nozzles of the entire head 20.

The above depositing positional displacement amount is calculated using the actually measured values. Specifically, the calculation can be carried out by the same method as in the case of calculating the depositing positional displacement amount at step S40 below, in which an approximate curve is created from the coordinates in the X direction of the lines in the analysis chart to calculate the depositing positional displacement amount is from the approximate curve. The approximate curve is created using coordinate data of N (e.g., 15) lines on both sides of the line of interest (coordinate data of the line of interest is not used for the calculation). From this approximate curve, the coordinate where the nozzle for the line of interest should be positioned is determined. Then, a difference between the coordinate where the nozzle should be positioned and an actual coordinate is the depositing positional displacement amount of the line of interest (the relevant nozzle).

The depositing positional displacement amounts for the number of nozzles of the entire head 20 are calculated by the above method, and the standard error of the depositing positional displacement amounts is the random depositing positional displacement σ. The random depositing positional displacement σ is a value actually determined, but is substantially constant depending on the inkjet head to be used, and thus, a constant 3 is used for the calculation in the embodiment.

Next, the total number of nozzles used for calculating the standard error is changed to calculate the standard error as in the calculation at step S33 (step S34). It is preferable to use the nozzles in ascending order of the conversion factor of the nozzle used for the calculation. This is because the standard error may be possibly smaller as the value of the conversion factor is smaller since the standard error is determined in accordance with Formula 1 above. A method for changing the total number of nozzles may include increasing the number of nozzles by the number of the lines having the next largest conversion factor after the conversion factors used in the previous calculation. The total number of nozzles used for the calculation is sufficient if nozzles in a region where the nozzles 24 of the head modules 22 adjacent to each other are mixed are counted in the total number. This is because the influence due to the other module is not so given even if the number of nozzles more than that is used for the calculation.

After calculating the standard error at step S33, the total number of nozzles (population) is changed and the process returns to step S33 to calculate the standard error. The calculation is carried out until the total number of nozzles includes the number of nozzles in the region where the nozzles of the modules adjacent to each other are mixed (step S34).

A denominator of a calculating formula of the above standard error can be decreased by increasing the total number of nozzles used for the calculation. On the other hand, since the nozzle farther from the other module has the larger conversion factor, a numerator of the above calculating formula becomes larger. As a result, in a course of increasing the total number of nozzles used for the calculation, the error reaches the minimum at a certain point. This number of nozzles capable of making the error minimum is determined as the number of nozzles for the population in the 12-division pattern.

FIG. 22 illustrates a result of the total number of nozzles and the standard error. As illustrated in the figure, in the case of the 12-division pattern, since the standard error is small when the total number of nozzles is 72, a measurement error of Δx may be confirmed to be minimized.

In FIG. 22, in the case of the total number of nozzles of 24, since the lines A1 and B1 are used and they exist in 12-division, the total number of nozzles is 24. A conversion factor average is an average of the conversion factors of the lines A1 and B1. Similarly, in the case of the total number of nozzles of 48, since the lines A2, A1, B1, and B2 are used and they exist in 12-division, the total number of nozzles is 48, and the conversion factor thereof is an average of those of the lines A2, A1, B1, and B2.

The total number of nozzles where the standard error is minimum is determined among from the standard errors calculated at step S33 and at step S34 (step S35).

Next, the number of divisions is changed and the conversion factors are determined by the same method as for the 12-division at steps S32 to S35, and then, while the total number of nozzles is changed, calculated is the number of nozzles where the measurement error of the depositing positional displacement amount is minimized, that is, the number of nozzles where the standard error is minimum (step S36).

Figure 23A:
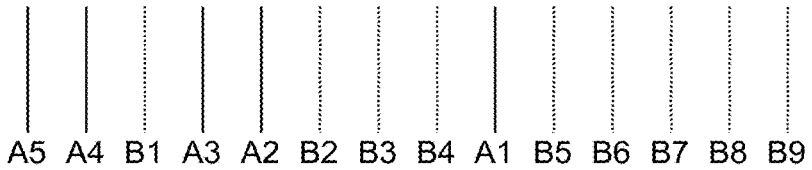
FIGS. 23A to 23C each are a diagram illustrating a pattern of a line alignment in each band in the overlap area.
Figure 23B:
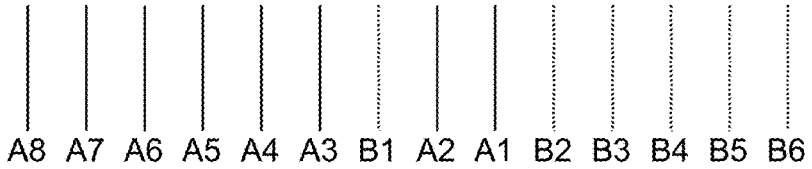

As an example in which the number of divisions is changed, a case of an 11-division pattern is described. In the case of the 11-division pattern, there are three patterns of line alignments in each band in the overlap area as illustrated in FIGS. 23A to 23C.

Figure 23C:
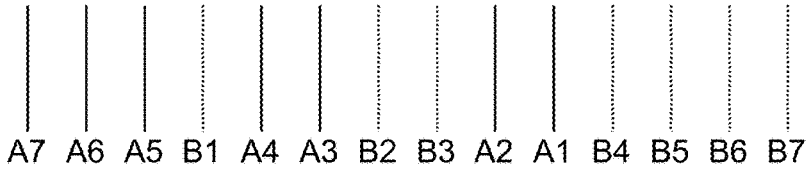

Here, a description is given of a method for determining the conversion factor of the line A1 in a pattern (3) illustrated in FIG. 23C. FIGS. 24A and 24B illustrate a relationship between the nozzle numbers and coordinates used for creating the approximate curve of the line A1. p=254 (μm) and Δx=1 (μm) are assigned for creating the approximate curve. Then, a position where the line A1 is positioned (nozzle #=166) is determined to obtain that the position where the line A1 is positioned is −0.75 (μm). Since the line A1 is to be actually positioned at a coordinate 0, the depositing positional displacement amount is −0.75 (μm) due to an influence of Δx=1 (μm). The conversion factor can be determined by carrying out a back calculation, to obtain the conversion factor=Δx÷(−0.75)=1÷(−0.75)=−1.34.

As for other lines, the conversion factors are determined by the same method.

In this way, the number of divisions is changed, and, in the division pattern for each number of divisions, the total number of nozzles where the standard error is minimum is calculated. The number of divisions may be adequately set depending on the inkjet head to be used, but it is sufficient to set the number of divisions to 20 at most.

Subsequently, from the result of the process at steps S31 to S36, determined are the number of divisions of the division pattern and the total number of nozzles both of which are used for Δx (step S37).

FIG. 25 illustrates a result representing the minimum value of the standard error in each division pattern from the 8-division to the 12-division. As illustrated in the figure, for the inkjet head used in the embodiment, the error of Δx can be minimized by setting the analysis chart to the 9-division pattern and setting the total number of nozzles (population) used for calculating Δx to 58. Alternatively, the analysis chart may be set to the 11-division and the total number of nozzles (population) used for calculating Δx may be set to 60.

Even if the analysis chart is set to the 10-division and the number of nozzles (population) used for calculating Δx is set to 66, the two patterns and standard error described above are only different by not more than 2%, which may be sufficiently used for calculating Δx.

After determining the number of divisions and the total number of nozzles at step S37, the standard error can be further lowered by making the division pattern into an unequal division (step S38). In the division pattern described above, the nozzles are divided with the equal division to create the analysis chart, but in the unequal division pattern, the nozzle interval in the band is not made regular for implementation.

The unequal division pattern is not specifically limited in its dividing way, and the various division patterns may be taken, but it is preferable to carry out the division by changing the arbitrary nozzle interval for the number of divisions which is determined by determining the number of divisions and the total number of nozzles at step S37. The reason why is that this can be a condition for further lowering the error, in addition to the condition of the minimum standard error determined in the equal division pattern.

Here, a description is given of a case where the equal division pattern of the 11-division is made into the unequal division.

In the case of the equal division pattern of the 11-division, there are three kinds of patterns as illustrated in FIGS. 23A to 23C. Here, a pattern (2) illustrated in FIG. 23B and a pattern (3) illustrated in FIG. 23C are made into the unequal division pattern. FIGS. 26A to 26C are an example of a case where a pattern (1) in the case of the 11-division remains the equal division, and the pattern (2) and the pattern (3) are made into the unequal division.

In the embodiment, the line A4 in the pattern (2) is made into the unequal division of a line $B_{A4}$ and the line A5 is made into the unequal division of a line $B_{A5}$. The line A4 is drawn by the nozzles 24*a* of the head module 22-*i*, but is changed into the line $B_{A4}$ positioned rightward by 3 pixels (63.5 (μm)), and thus, is to be drawn by the nozzles 24*b* of the head module 22-(*i*+1). The line A5 is drawn by the nozzles 24*a* of the head module 22-*i*, but is changed into the line $B_{A5}$ positioned rightward by 1 pixel (21.2 (μm)), and thus, is to be in a pattern using the nozzles 24*b* of the head module 22-(*i*+1). Similarly, the line B3 is made into the unequal division of a line $A_{B3}$ and the line B4 is made the unequal division into of $A_{B4}$. The line B3 is drawn by the nozzles 24*b* of the head module 22-(*i*+1), but is changed into the line $A_{B3}$ positioned leftward by 3 pixels (63.5 (μm)), and thus, is to be drawn by the nozzles 24*a* of the head module 22-*i*. The line B4 is drawn by the nozzles 24*b* of the head module 22-(*i*+1), but is changed into the line $A_{B4}$ positioned leftward by 1 pixel (21.2 (μm)), and thus, is to be drawn by the nozzles 24*a* of the head module 22-*i*.

Similarly, regarding the pattern (3), if the line A4 is changed into the line $B_{A4}$ positioned rightward by 1 pixel (21.2 (μm)), it can be a pattern using the nozzles 24*b* of the head module 22-(*i*+1), and if the line B5 is changed into the line $A_{B5}$ positioned leftward by 2 pixels (42.3 (μm)), it can be a pattern using the nozzles 24*a* of the head module 22-*i*.

Next, a description is given of a method for calculating the conversion factor for the unequal division pattern in the pattern (3) illustrated in FIG. 26C. FIGS. 27A and 27B are table diagrams illustrating a relationship between the nozzle number and the coordinate used for creating the approximate curve of the line A1.

Similarly to the case of the equal division pattern, p=254 (μm) and Δx=1 (μm) are assigned for creating the approximate curve. The approximate curve is created by use of 30 lines and a position where the line A1 is positioned (nozzle #=166) is determined to obtain that the position where the line A1 is positioned is −0.72 (μm). Since the line A1 is to be actually positioned at a coordinate 0, the depositing positional displacement is −0.72 (μm) due to the influence of Δx=1 (μm). The conversion factor can be determined by carrying out a back calculation, to obtain the conversion factor=Δx÷(−0.72)=1÷(−0.72)=−1.38.

In this way, the conversion factors of the lines in each pattern are calculated in the case of changing the pattern, and while the total number of nozzles is increased, the total number of nozzles where the standard error of Δx is minimum is determined (step S39).

FIG. 28 illustrates a result. As illustrated in the figure, in the case where the standard errors are measured in the unequal division patterns as illustrated in FIGS. 26A to 26C, 74 lines are used to determine an average Δx to allow the accuracy to be improved compare to the case of the equal pattern.

The unequal division pattern in the embodiment is formed by using the division pattern with the standard error of Δx being small in the equal division pattern and changing the nozzle which draws some lines into the nozzle of the other head module, but the creating method of the unequal division pattern is not limited thereto, and various patterns can be created.

The equal division pattern may not be carried out and the standard error can be measured directly by the unequal division pattern. In this case, the pattern can be adequately set.

Finally, by means of the determined number of divisions and the nozzles of the determined total number of nozzles, the between-modules depositing positional displacement shift amount Δx is calculated as the precise measurement shift amount (step S40, an example of a precise analyzing step). The between-modules depositing positional displacement shift amount Δx can be determined in accordance with Δx=depositing positional displacement amount×conversion factor.

The above processes makes it possible to measure the between-modules depositing positional displacement shift amount smaller than the readout resolution of the scanner 50, and as for the measurable region even if the between-modules depositing positional displacement shift amount is large with no problem.

In the embodiment, the analysis chart is read out by the scanner 50, but the analysis chart recorded by the head 20 may be read out by a commercial scanner.

<Relationship Between Rough Measurement Scheme and Precise Measurement Scheme>

Assuming that the measurement accuracy and measurable region (the first dynamic range) of the precise measurement scheme are $P_A$ and $P_D$, respectively, and the measurement accuracy and measurable region (an example of the second dynamic range) of the rough measurement scheme are $R_A$ and $R_D$, respectively, these have the following relationship.

$P_A < R_A$ (the accuracy of the precise measurement scheme is better than that of the rough measurement scheme) (Formula 2)

$P_D < R_D$ (the measurable region of the rough measurement scheme is wider than that of the precise measurement scheme) (Formula 3)

$R_A < P_D$ (the accuracy of the rough measurement scheme is finer than that of the measurable region in the precise measurement scheme) (Formula 4)

In the embodiment, the technology described in Japanese Patent Application Laid-Open No. 2014-083720 can be used for the precise measurement scheme. On the other hand, the rough measurement scheme is required to meet the relationships of Formula 2 to Formula 4 above with respect to the precise measurement scheme.

As for Formula 2, in the rough measurement scheme, the head modules adjacent to each other independently draw the analysis charts redundantly, and the positions of the respective reference nozzles are independently determined by applying the least-square technique under the priori information that the manufacturing accuracy of the head module is reliable, and then, the between-modules depositing positional displacement shift amount is determined with the measurement accuracy more than the readout resolution of the scanner. On the other hand, in the precise measurement scheme, the head modules adjacent to each other are used in combination to mixedly draw the analysis chart to collect many pieces of measurement information, and then, in consideration of the measurement error caused by a nozzle layout and a line layout of the analysis chart, and data used for calculating the between-modules depositing positional displacement shift amount is sorted out and so on to dependently determine the between-modules depositing positional displacement shift amount. For example, in the case of using the scanner of 480 (dpi), the between-modules depositing positional displacement shift amount of about 1 (μm) can be distinguished between the head modules having the recording resolution of 1200 (dpi). Therefore, the measurement accuracy $R_A$ of the precise measurement scheme is sufficiently higher than the measurement accuracy $P_A$ of the rough measurement scheme, meeting Formula 2.

As for Formula 3, if the recording resolution is 1200 (dpi) and the analysis chart is the 10-division pattern as described above, the measurable region $P_D$ of the precise measurement scheme is about 212 (μm). In a case where the influence due to the readout resolution of the scanner is rate-limiting, if the readout resolution is 480 (dpi) and the analysis chart is the 10-division pattern, the measurable region $P_D$ of the precise measurement scheme is about 106 (μm) as described using FIGS. 11A and 11B. On the other hand, the measurable region $P_D$ of the rough measurement scheme reaches a measurable range of the scanner and is almost infinite. Therefore, the measurable region $R_D$ of the rough measurement scheme is wider than the measurable region $P_D$ of the precise measurement scheme, meeting Formula 3.

As for Formula 4, the measurement accuracy $R_A$ of the rough measurement scheme is decimal places of the readout resolving capability and sufficiently smaller than the readout resolving capability. On the other hand, the measurable region $P_D$ of the precise measurement scheme is larger than the readout resolving capability. Therefore, the measurement accuracy $R_A$ of the rough measurement scheme is finer than the measurable region $P_D$ of the precise measurement scheme, meeting Formula 4.

Assuming that the measurement result of the precise measurement scheme (between-modules depositing positional displacement shift amount) is $P_X$, the measurement result of the rough measurement scheme is $R_X$, determined is whether or not Formula 5 is satisfied, that is, whether or not the measurement result of the rough measurement scheme exceeds the measurable region of the precise measurement scheme (step S4 in FIG. 13).

$R_X > P_D$ (Formula 5)

If this determination is positive, $R_X$ is considered to be the correct between-modules depositing positional displacement shift amount, and if negative, $P_X$ is considered to be the correct one.

Immediately after attaching the head module 22, the measurement may possibly be failed in the precise measurement scheme, but in that case, the measurement result $R_X$ in the rough measurement scheme is prioritized. If the physical position is adjusted on the basis of this measurement result $R_X$, that adjustment accuracy can be expected to be $R_A$. If the measurement is carried out again in this state, in accordance with the relationship in Formula 4, the determination in Formula 5 is considered to be negative, and the measurement result $P_X$ of the precise measurement scheme can be expected to be applied in the next measurement result. If the physical position is readjusted on the basis of this measurement result $P_X$, that adjustment accuracy can be expected to be $P_A$. After that, even if the readjustment of the physical position is repeated, the result of the precise measurement scheme is expected to be always used.

Therefore, according to the embodiment, even if the inkjet head is adjusted from a state where the between-modules depositing positional displacement shift amount between the head modules is large, the adjustment result with the high accuracy can be obtained.

The technical scope of the present invention is not limited to the scope of the embodiments described above. The configurations and the like in the embodiments can be appropriately combined across the embodiments within the scope not departing from the gist of the present invention.

What is claimed is:

1. A method for analyzing a positional displacement between head modules of a recording head in which plural head modules each having a plurality of recording elements arranged thereon are connected and joined in a first direction, and the head modules adjacent to each other have an overlapping area in a second direction crossing the first direction, the method comprising:

a first measurement chart recording step of recording a first measurement chart on a recording medium by the recording head;

a first measurement chart reading-out step of reading out the recorded first measurement chart by a reading-out device to acquire read data of the first measurement chart;

a precise analyzing step of analyzing the read data of the first measurement chart in a first dynamic range to calculate a positional displacement shift amount between the head modules in the first direction with a first arithmetic accuracy;

a second measurement chart recording step of recording a second measurement chart on a recording medium by the recording head;

a second measurement chart reading-out step of reading out the recorded second measurement chart by the reading-out device to acquire read data of the second measurement chart;

a rough analyzing step of analyzing the read data of the second measurement chart in a second dynamic range wider than the first dynamic range to calculate the positional displacement shift amount between the head modules in the first direction with a second arithmetic accuracy rougher than the first arithmetic accuracy and finer than the first dynamic range; and a measurement result selecting step of selecting the positional displacement shift amount with the second arithmetic accuracy as the positional displacement shift amount between the head modules in the first direction in a case where the positional displacement shift amount with the second arithmetic accuracy calculated in the rough analyzing step exceeds the first dynamic range, and selecting the positional displacement shift amount with the first arithmetic accuracy calculated in the precise analyzing step as the positional displacement shift amount between the head modules in the first direction in a case where the positional displacement shift amount with the second arithmetic accuracy is within the first dynamic range.

2. The method for analyzing a positional displacement between head modules according to claim 1, wherein in the second measurement chart recording step, the respective head modules adjacent to each other independently record the second measurement chart, and in the rough analyzing step, respective physical positions of the head modules adjacent to each other are independently calculated.

3. The method for analyzing a positional displacement between head modules according to claim 2, wherein in the second measurement chart recording step, the second measurement chart including a plurality of line images are recorded by a plurality of recording elements respectively predefined from the head modules adjacent to each other, and in the rough analyzing step, read data of the plurality of line images is analyzed to independently calculate the respective physical positions of the head modules adjacent to each other.

4. The method for analyzing a positional displacement between head modules according to claim 3, wherein in the rough analyzing step, a least-square technique is applied to the read data of the plurality of line images to generate a mapping function between a position of a read pixel of the reading-out device in the first direction and a position of the recording element in the first direction.

5. The method for analyzing a positional displacement between head modules according to claim 4, wherein in the rough analyzing step, a readout resolving capability of the reading-out device is calculated according to the mapping function.

6. The method for analyzing a positional displacement between head modules according to claim 3, wherein the line image includes a line image extending along the second direction, and a length of the line image in the first direction is longer than the readout resolving capability of the reading-out device.

7. The method for analyzing a positional displacement between head modules according to claim 1, wherein in the first measurement chart recording step, the head modules adjacent to each other are used in combination to mixedly record the first measurement chart, and in the precise analyzing step, the physical positions of the head modules adjacent to each other are dependently calculated.

8. The method for analyzing a positional displacement between head modules according to claim 1, wherein the first measurement chart recording step and the second measurement chart recording step are performed on one recording medium.

9. A non-transitory computer-readable recording medium including instructions stored thereon, such that when the instructions are read and executed by a processor, the processor is configured to perform steps of the method for analyzing a positional displacement between head modules according to claim 1.

10. A method for adjusting a recording head, comprising:

the method for analyzing a positional displacement between head modules according to claim 1; and an adjusting step of adjusting positional displacements of the head modules adjacent to each other according to the positional displacement shift amount between the head modules in the first direction selected in the measurement result selecting step.

11. An image recording apparatus comprising:

a recording head in which plural head modules each having a plurality of recording elements arranged thereon are connected and joined in a first direction, and the head modules adjacent to each other have an overlapping area in a second direction crossing the first direction;

a moving device configured to move the recording head and a recording medium relative to each other;

a first measurement chart recording device configured to record a first measurement chart on the recording medium by the recording head;

a first measurement chart reading-out device configured to read out the recorded first measurement chart to acquire read data of the first measurement chart;

a precise analyzing device configured to analyze the read data of the first measurement chart in a first dynamic range to calculate a positional displacement shift amount between the head modules in the first direction with a first arithmetic accuracy;

a second measurement chart recording device configured to record a second measurement chart on the recording medium by the recording head;

a second measurement chart reading-out device configured to read out the recorded second measurement chart to acquire read data of the second measurement chart;

a rough analyzing device configured to analyze the read data of the second measurement chart in a second dynamic range wider than the first dynamic range to calculate the positional displacement shift amount between the head modules in the first direction with a second arithmetic accuracy rougher than the first arithmetic accuracy and finer than the first dynamic range; and a measurement result selecting device configured to select the positional displacement shift amount with the second arithmetic accuracy as the positional displacement shift amount between the head modules in the first direction in a case where the positional displacement shift amount with the second arithmetic accuracy calculated by the rough analyzing device exceeds the first dynamic range, and select the positional displacement shift amount with the first arithmetic accuracy calculated by the precise analyzing device as the positional displacement shift amount between the head modules in the first direction in a case where the positional displacement shift amount with the second arithmetic accuracy is within the first dynamic range.

* * * * *